US007973723B2

(12) United States Patent
Lin

(10) Patent No.: US 7,973,723 B2
(45) Date of Patent: Jul. 5, 2011

(54) ELECTRIC DEVICE AND ANTENNA MODULE THEREOF

(75) Inventor: Hui Lin, Taoyuan (TW)

(73) Assignee: Quanta Computer Inc., Tao Tuan Shien (TW)

( * ) Notice: Subject to any disclaimer, the term of this patent is extended or adjusted under 35 U.S.C. 154(b) by 754 days.

(21) Appl. No.: 12/007,201

(22) Filed: Jan. 8, 2008

(65) Prior Publication Data

US 2009/0073058 A1 Mar. 19, 2009

(30) Foreign Application Priority Data

Sep. 14, 2007 (TW) ..... 96134579 A

(51) Int. Cl.
*H01Q 1/24* (2006.01)

(52) U.S. Cl. ..... 343/702

(58) Field of Classification Search ..... 343/702, 343/700 MS, 846–848
See application file for complete search history.

(56) References Cited

U.S. PATENT DOCUMENTS

| | | | | |
|---|---|---|---|---|
| 4,021,813 | A * | 5/1977 | Black et al. | 343/768 |
| 6,025,805 | A | 2/2000 | Smith et al. | |
| 6,786,769 | B2 | 9/2004 | Lai | |
| 7,532,164 | B1 * | 5/2009 | Phillips et al. | 343/700 MS |
| 7,535,422 | B2 * | 5/2009 | Liu et al. | 343/702 |
| 7,598,912 | B2 * | 10/2009 | Lee | 343/700 MS |
| 7,705,784 | B2 * | 4/2010 | Lai et al. | 343/700 MS |
| 2007/0010300 | A1 | 1/2007 | Xue et al. | |
| 2008/0122698 | A1 * | 5/2008 | Ollikainen et al. | 343/700 MS |
| 2009/0303135 | A1 * | 12/2009 | Reed et al. | 343/702 |

FOREIGN PATENT DOCUMENTS

| | | | |
|---|---|---|---|
| TW | 547788 | Y | 8/2003 |
| TW | 549613 | Y | 8/2003 |
| TW | 568379 | Y | 12/2003 |
| TW | M257522 | | 2/2005 |

* cited by examiner

*Primary Examiner* — Huedung Mancuso
(74) *Attorney, Agent, or Firm* — Rabin & Berdo, P.C.

(57) ABSTRACT

An electronic device and an antenna module thereof are provided. The electronic device includes a plurality of electronic elements and the antenna module. The antenna module includes a radiating body and a grounding body. The grounding body covers the electronic elements for being a shielding casing. A radio frequency resonance is formed between the radiating body and the grounding body.

14 Claims, 24 Drawing Sheets

X-Y Plane, Gain=4.732dBi,
Efficiency=59.436%@2.4GHz

X-Y Plane, Gain=4.404dBi,
Efficiency=57.238%@2.45GHz

X-Y Plane, Gain=4.070dBi,
Efficiency=55.936%@2.5GHz

X-Y Plane, Gain=2.841dBi,
Efficiency=32.746%@5.15GHz

X-Y Plane, Gain=3.829dBi,
Efficiency=42.904%@5.25GHz

X-Z Plane, Gain=3.607dBi,
Efficiency=64.319%@5.35GHz

X-Y Plane, Gain=3.907dBi,
Efficiency=58.691%@5.47GHz

X-Y Plane, Gain=5.093dBi,
Efficiency=51.228%@5.6GHz

X-Y Plane, Gain=7.318dBi,
Efficiency=56.475%@5.725GHz

X-Y Plane, Gain=7.629dBi,
Efficiency=49.340%@5.825GHz

X-Y Plane, Gain=6.897dBi,
Efficiency=43.195%@5.85GHz

Y-Z Plane, Gain=4.732dBi,
Efficiency=59.436%@2.4GHz

Y-Z Plane, Gain=4.404dBi,
Efficiency=57.238%@2.45GHz

Y-Z Plane, Gain=4.070dBi,
Efficiency=55.936%@2.5GHz

Y-Z Plane, Gain=2.841dBi,
Efficiency=32.746%@5.15GHz

Y-Z Plane, Gain=3.829dBi,
Efficiency=42.904%@5.25GHz

Y-Z Plane, Gain=3.607dBi,
Efficiency=64.319%@5.35GHz

Y-Z Plane, Gain=3.907dBi,
Efficiency=58.691%@5.47GHz

Y-Z Plane, Gain=5.093dBi,
Efficiency=51.228%@5.6GHz

Y-Z Plane, Gain=7.318dBi,
Efficiency=56.475%@5.725GHz

Y-Z Plane, Gain=7.629dBi,
Efficiency=49.340%@5.825GHz

X-Z Plane, Gain=6.897dBi,
Efficiency=43.195%@5.85GHz

X-Z Plane, Gain=4.732dBi,
Efficiency=59.436%@2.4GHz

X-Z Plane, Gain=4.404dBi,
Efficiency=57.238%@2.45GHz

X-Z Plane, Gain=4.070dBi,
Efficiency=55.936%@2.5GHz

X-Z Plane, Gain=2.841dBi,
Efficiency=32.746%@5.15GHz

X-Z Plane, Gain=3.829dBi,
Efficiency=42.904%@5.25GHz

X-Z Plane, Gain=3.607dBi,
Efficiency=64.319%@5.35GHz

X-Z Plane, Gain=3.907dBi,
Efficiency=58.691%@5.47GHz

X-Z Plane, Gain=5.093dBi,
Efficiency=51.228%@5.6GHz

X-Z Plane, Gain=7.318dBi,
Efficiency=56.475%@5.725GHz

X-Z Plane, Gain=7.629dBi,
Efficiency=49.340%@5.825GHz

X-Z Plane, Gain=6.897dBi,
Efficiency=43.195%@5.85GHz

X-Y Plane, Gain=5.479dBi,
Efficiency=62.772%@2.4GHz

X-Y Plane, Gain=4.763dBi,
Efficiency=58.013%@2.45GHz

X-Y Plane, Gain=3.966dBi,
Efficiency=52.098%@2.5GHz

X-Y Plane, Gain=4.051dBi,
Efficiency=43.185%@5.15GHz

X-Y Plane, Gain=4.442dBi,
Efficiency=48.434%@5.25GHz

X-Y Plane, Gain=3.714dBi,
Efficiency=56.466%@5.35GHz

X-Y Plane, Gain=5.643dBi,
Efficiency=53.338%@5.47GHz

X-Y Plane, Gain=5.411dBi,
Efficiency=57.370%@5.6GHz

X-Y Plane, Gain=6.527dBi,
Efficiency=58.389%@5.725GHz

X-Y Plane, Gain=7.831dBi,
Efficiency=61.156%@5.825GHz

X-Y Plane, Gain=7.629dBi,
Efficiency=56.910%@5.85GHz

Y-Z Plane, Gain=5.479dBi,
Efficiency=62.772%@2.4GHz

Y-Z Plane, Gain=4.763dBi,
Efficiency=58.013%@2.45GHz

Y-Z Plane, Gain=3.966dBi,
Efficiency=52.098%@2.5GHz

Y-Z Plane, Gain=4.051dBi,
Efficiency=43.185%@5.15GHz

Y-Z Plane, Gain=4.442dBi,
Efficiency=48.434%@5.25GHz

Y-Z Plane, Gain=3.714dBi,
Efficiency=56.466%@5.35GHz

Y-Z Plane, Gain=5.643dBi,
Efficiency=53.338%@5.47GHz

Y-Z Plane, Gain=5.411dBi,
Efficiency=57.370%@5.6GHz

Y-Z Plane, Gain=6.527dBi,
Efficiency=58.389%@5.725GHz

Y-Z Plane, Gain=7.831dBi,
Efficiency=61.156%@5.825GHz

Y-Z Plane, Gain=7.629dBi,
Efficiency=56.910%@5.85GHz

X-Z Plane, Gain=5.479dBi,
Efficiency=62.772%@2.4GHz

X-Z Plane, Gain=4.763dBi,
Efficiency=58.013%@2.45GHz

X-Z Plane, Gain=3.966dBi,
Efficiency=52.098%@2.5GHz

X-Z Plane, Gain=4.051dBi,
Efficiency=43.185%@5.15GHz

X-Z Plane, Gain=4.442dBi,
Efficiency=48.434%@5.25GHz

X-Z Plane, Gain=3.714dBi,
Efficiency=56.466%@5.35GHz

X-Z Plane, Gain=5.643dBi,
Efficiency=53.338%@5.47GHz

X-Z Plane, Gain=5.411dBi,
Efficiency=57.370%@5.6GHz

X-Z Plane, Gain=6.527dBi,
Efficiency=58.389%@5.725GHz

X-Z Plane, Gain=7.831dBi,
Efficiency=61.156%@5.825GHz

X-Z Plane, Gain=7.629dBi,
Efficiency=56.910%@5.85GHz

X-Y Plane, Gain=4.943dBi,
Efficiency=64.386%@2.4GHz

X-Y Plane, Gain=3.982dBi,
Efficiency=63.433%@2.45GHz

X-Y Plane, Gain=3.745dBi,
Efficiency=57.514%@2.5GHz

X-Y Plane, Gain=1.566dBi,
Efficiency=44.390%@5.15GHz

X-Y Plane, Gain=2.247dBi,
Efficiency=51.141%@5.25GHz

X-Y Plane, Gain=3.453dBi,
Efficiency=47.268%@5.35GHz

X-Y Plane, Gain=4.219dBi,
Efficiency=53.309%@5.47GHz

X-Y Plane, Gain=4.505dBi,
Efficiency=58.388%@5.6GHz

X-Y Plane, Gain=4.815dBi,
Efficiency=56.916%@5.725GHz

X-Y Plane, Gain=4.941dBi,
Efficiency=71.909%@5.825GHz

X-Y Plane, Gain=4.582dBi,
Efficiency=62.578%@5.85GHz

Y-Z Plane, Gain=4.943dBi,
Efficiency=64.386%@2.4GHz

Y-Z Plane, Gain=3.982dBi,
Efficiency=63.433%@2.45GHz

Y-Z Plane, Gain=3.745dBi,
Efficiency=57.514%@2.5GHz

Y-Z Plane, Gain=1.566dBi,
Efficiency=44.390%@5.15GHz

Y-Z Plane, Gain=2.247dBi,
Efficiency=51.141%@5.25GHz

Y-Z Plane, Gain=3.453dBi,
Efficiency=47.268%@5.35GHz

Y-Z Plane, Gain=4.219dBi,
Efficiency=53.309%@5.47GHz

Y-Z Plane, Gain=4.505dBi,
Efficiency=58.388%@5.6GHz

Y-Z Plane, Gain=4.815dBi,
Efficiency=56.916%@5.725GHz

Y-Z Plane, Gain=4.941dBi,
Efficiency=71.909%@5.825GHz

Y-Z Plane, Gain=4.582dBi,
Efficiency=62.578%@5.85GHz

X-Z Plane, Gain=4.943dBi,
Efficiency=64.386%@2.4GHz

X-Z Plane, Gain=3.982dBi,
Efficiency=63.433%@2.45GHz

X-Z Plane, Gain=3.745dBi,
Efficiency=57.514%@2.5GHz

X-Z Plane, Gain=1.566dBi,
Efficiency=44.39%@5.15GHz

X-Z Plane, Gain=2.247dBi,
Efficiency=51.141%@5.25GHz

X-Z Plane, Gain=3.453dBi,
Efficiency=47.268%@5.35GHz

X-Z Plane, Gain=4.219dBi,
Efficiency=53.309%@5.47GHz

X-Z Plane, Gain=4.505dBi,
Efficiency=58.388%@5.6GHz

X-Z Plane, Gain=4.815dBi,
Efficiency=56.916%@5.725GHz

X-Z Plane, Gain=4.941dBi,
Efficiency=71.909%@5.825GHz

X-Z Plane, Gain=4.582dBi,
Efficiency=62.578%@5.85GHz

ELECTRIC DEVICE AND ANTENNA MODULE THEREOF

This application claims the benefit of Taiwan application Serial No. 096134579, filed Sep. 14, 2007, the subject matter of which is incorporated herein by reference.

BACKGROUND OF THE INVENTION

1. Field of the Invention

The invention relates in general to an electronic device and an antenna module thereof, and more particularly to an electronic device having a shielding casing and an antenna module thereof.

2. Description of the Related Art

Wireless communication, not subjected to the restriction of place nor requiring cable, has high mobility and has been widely used in various electronic devices. With regard to wireless communication technology, the design of antenna module places a very important role.

Referring to FIG. 1, a perspective of a conventional notebook computer 900 and an antenna module 920 is shown. The notebook computer 900 includes a host 930 and a display panel 940. As the structure of the notebook computer 900 is so complicated, the notebook computer 900 is susceptible to electromagnetic interference which occurs between internal electronic elements or due to external noises. To prevent the electronic elements of the notebook computer 900 from being affected by the above electromagnetic interference, a shielding casing 950 is used for covering the electronic elements.

However, the shielding casing 950 also shields the radiation of the antenna module 920, and becomes a barrier to the antenna module 920. Thus, the disposition of the antenna module 920 must avoid the shielding casing 950.

Referring to FIG. 2, FIGS. 3A~3K, FIGS. 4A~4K and FIGS. 5A~5K. FIG. 2 is a return loss vs. frequency curve diagram of the antenna module 920 of FIG. 1. FIGS. 3A~3K are diagrams of far-field power distribution of the antenna module 920 of FIG. 1 on X-Y plane. FIGS. 4A~4K are diagrams of far-field power distribution of the antenna module 920 of FIG. 1 on Y-Z plane. FIGS. 5A~5K are diagrams of far-field power distribution of the antenna module 920 of FIG. 1 on Z-X plane. According to the experimental results, the return loss, the radiation efficiency, the peak gain and the average gain at each frequency band are respectively shown in Table 1.1~Table 1.6.

TABLE 1.1

| | Return Loss | | | |
|---|---|---|---|---|
| Frequency Band (GHz) | 2.4 | 2.5 | 5.15 | 5.875 |
| Measurement Result | 17.01 | 13.42 | 11.08 | 12.27 |

As indicated in Table 1.1, when the antenna module 920 is at the frequency width of 2.4 GHz, 2.5 GHz, 5.15 GHz and 5.875 GHz, the return loss has a maximum value of 17.014 dBi and a minimum of 11.083 dBi, and the difference between the maximum return loss and the minimum return loss is 5.931 dBi. The experiment results show that the antenna module 920, despite having avoided the shielding casing 950, is still affected by the shielding casing 950 and has an over-diversified distribution of return loss at different frequency bands.

TABLE 1.2

| Radiation Efficiency | |
|---|---|
| Frequency | Radiation Efficiency |
| 2.400 GHz | 59.43 |
| 2.450 GHz | 57.23 |
| 2.500 GHz | 55.93 |
| 5.150 GHz | 32.74 |
| 5.250 GHz | 42.90 |
| 5.350 GHz | 64.31 |
| 5.470 GHz | 58.69 |
| 5.600 GHz | 51.22 |
| 5.725 GHz | 56.47 |
| 5.825 GHz | 49.34 |
| 5.850 GHz | 43.19 |

As indicated in Table 1.2, of the 11 points measured when the antenna module 120 is at the frequency band of 2.4 GHz~5.85 GHz, the radiation efficiency has a maximum value of 64.31% and a minimum value of 32.74%, and the difference between the maximum and the minimum radiation efficiency is 31.57%. For ordinary radiation efficiency, the acceptable minimum level is 45%. However, in the above frequency bands, there are three frequency bands (5.15 GHz, 5.25 GHz and 5.85 GHz) whose radiation efficiencies are lower than the minimum level. The experiment results show that the antenna module 920, despite having avoided the shielding casing 950, is still affected by the shielding casing 950 and has an over-diversified distribution of radiation frequency at different frequency bands and too many frequency bands are below the minimum radiation frequency.

TABLE 1.3

| Peak Gain (dBi) | | | | | | |
|---|---|---|---|---|---|---|
| | Frequency Band (GHz) | | | | | |
| | 2.4 | 2.45 | 2.5 | 5.15 | 5.25 | 5.35 |
| X-Y | 4.73 | 4.40 | 4.07 | 2.84 | 3.82 | 3.60 |
| Y-Z | | | | | | |
| Z-X | | | | | | |

TABLE 1.4

| Peak Gain (dBi) | | | | | |
|---|---|---|---|---|---|
| | Frequency Band (GHz) | | | | |
| | 5.47 | 5.6 | 5.725 | 5.825 | 5.85 |
| X-Y | 3.90 | 5.09 | 7.31 | 7.62 | 6.89 |
| Y-Z | | | | | |
| Z-X | | | | | |

As indicated in Table 1.3~1.4, of the 11 points measured when the antenna module 120 is at the frequency band of 2.4 GHz~5.85 GHz, the peakgain has a maximum value of 7.62 dBi and a minimum value of 2.84 dBi, and the difference between the maximum and the minimum peak gain is 4.78 dBi. The experiment results show that the antenna module 920, despite having avoided the shielding casing 950, is still affected by the shielding casing 950 and has an over-diversified distribution of peak gain at different frequency bands.

TABLE 1.5

| | Average Gain (dBi) | | | | |
|---|---|---|---|---|---|
| | Frequency Band (GHz) | | | | |
| | 2.4 | 2.45 | 2.5 | 5.15 | 5.25 |
| X-Y | −4.54 | −4.50 | −4.26 | −7.00 | −5.43 |
| Y-Z | −3.62 | −3.92 | −3.89 | −6.14 | −3.50 |
| Z-X | −2.37 | −2.50 | −2.62 | −5.30 | −3.88 |

TABLE 1.6

| | Average Gain (dBi) | | | | | |
|---|---|---|---|---|---|---|
| | Frequency Band (GHz) | | | | | |
| | 5.35 | 5.47 | 5.6 | 5.725 | 5.825 | 5.85 |
| X-Y | −4.31 | −3.96 | −4.51 | −4.76 | −5.44 | −5.93 |
| Y-Z | −3.01 | −2.63 | −3.09 | −2.78 | −4.11 | −4.48 |
| Z-X | −2.94 | −2.07 | −2.09 | −2.16 | −2.51 | −3.04 |

As indicated in Table 1.5~1.6, of the 11 X-Y plane points measured when the antenna module 120 is at the frequency band of 2.4 GHz~5.85 GHz, the average gain has a maximum value of −7.00 dBi and a minimum value of −3.96 dBi, and the difference between the maximum and the minimum average gain is 3.04 dBi. The experiment results show that the antenna module 920, despite having avoided the shielding casing 950, is still affected by the shielding casing 950 and has an over-diversified distribution of average gain at different frequency bands.

During the design of the antenna module 920, the antenna module 920 must go through serial tests to find out the most suitable position of disposition. However, despite the antenna module 920 is disposed at the most suitable position, the antenna module 920 is still affected by the shielding casing 950. In order to avoid the antenna module 920 being affected by the shielding casing 950, the antenna module 920 may even be disposed at a position with poor direction of frequency radiation. Thus, how to develop an electronic device and an antenna module capable of enhancing signal radiation has become an imminent issue to be resolved.

SUMMARY OF THE INVENTION

The invention is directed to an electronic device and an antenna module thereof. The shielding casing is used as a grounding body of the antenna module for preventing the antenna module from being affected by the shielding casing, hence reducing the interference of external noise on the antenna module.

According to a first aspect of the present invention, an electronic device including a plurality of electronic elements and an antenna module are provided. The antenna module includes a radiating body and a grounding body. The grounding body covers the electronic elements for being a shielding casing of the electronic elements. At least a radio frequency resonance is excited between the radiating body and the grounding body.

According to a second aspect of the present invention, an antenna module disposed in an electronic device is provided. The electronic device includes a plurality of electronic elements and an antenna module. The antenna module includes a radiating body and a grounding body. The grounding body covers the electronic elements for being a shielding casing of the electronic elements. At least a radio frequency resonance is excited between the radiating body and the grounding body.

The invention will become apparent from the following detailed description of the preferred but non-limiting embodiments. The following description is made with reference to the accompanying drawings.

DETAILED DESCRIPTION OF THE INVENTION

First Embodiment

Figure 1:
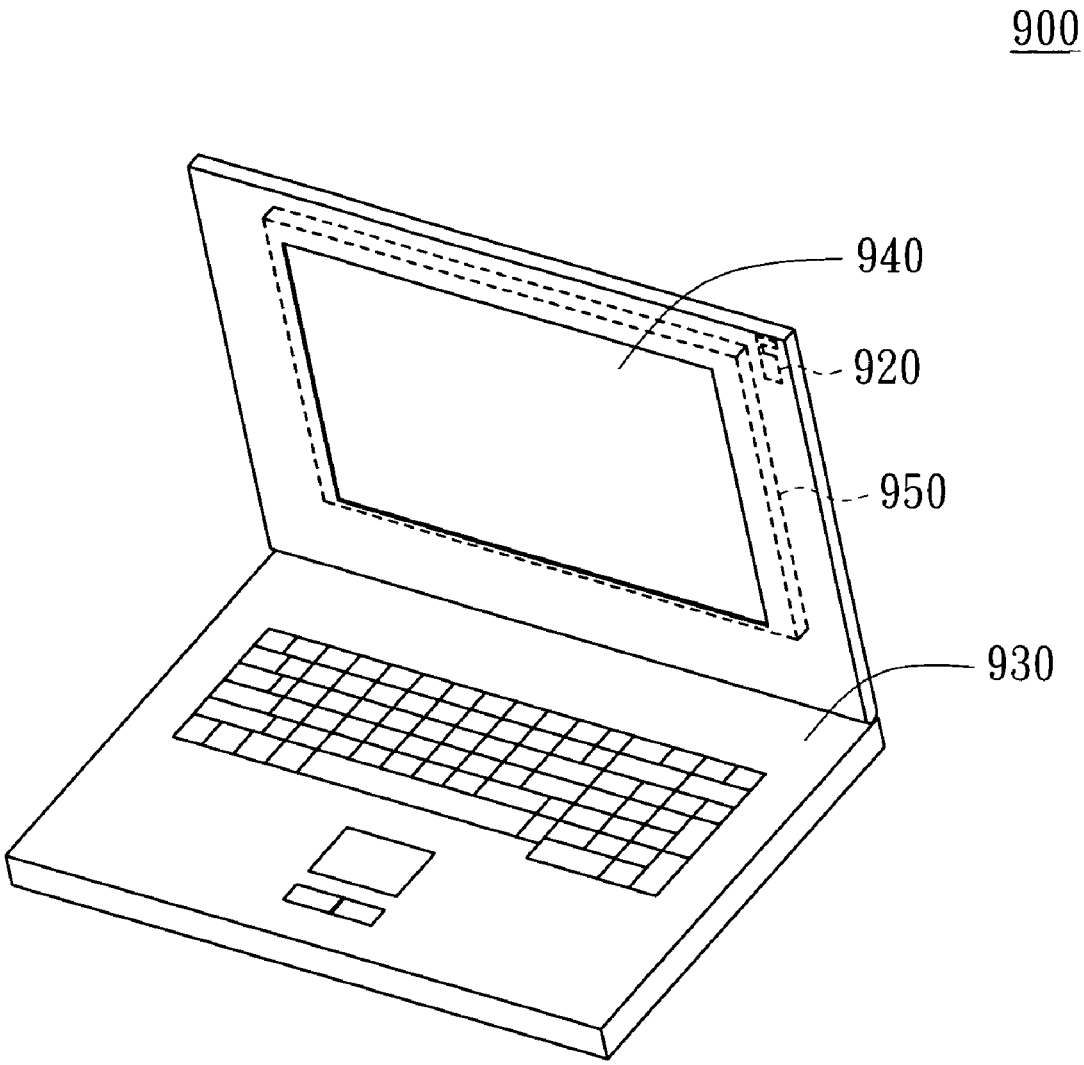
FIG. 1(PRIOR ART)
FIG. 1 (Prior Art) is a perspective of a conventional notebook computer and an antenna module.
Figure 2:
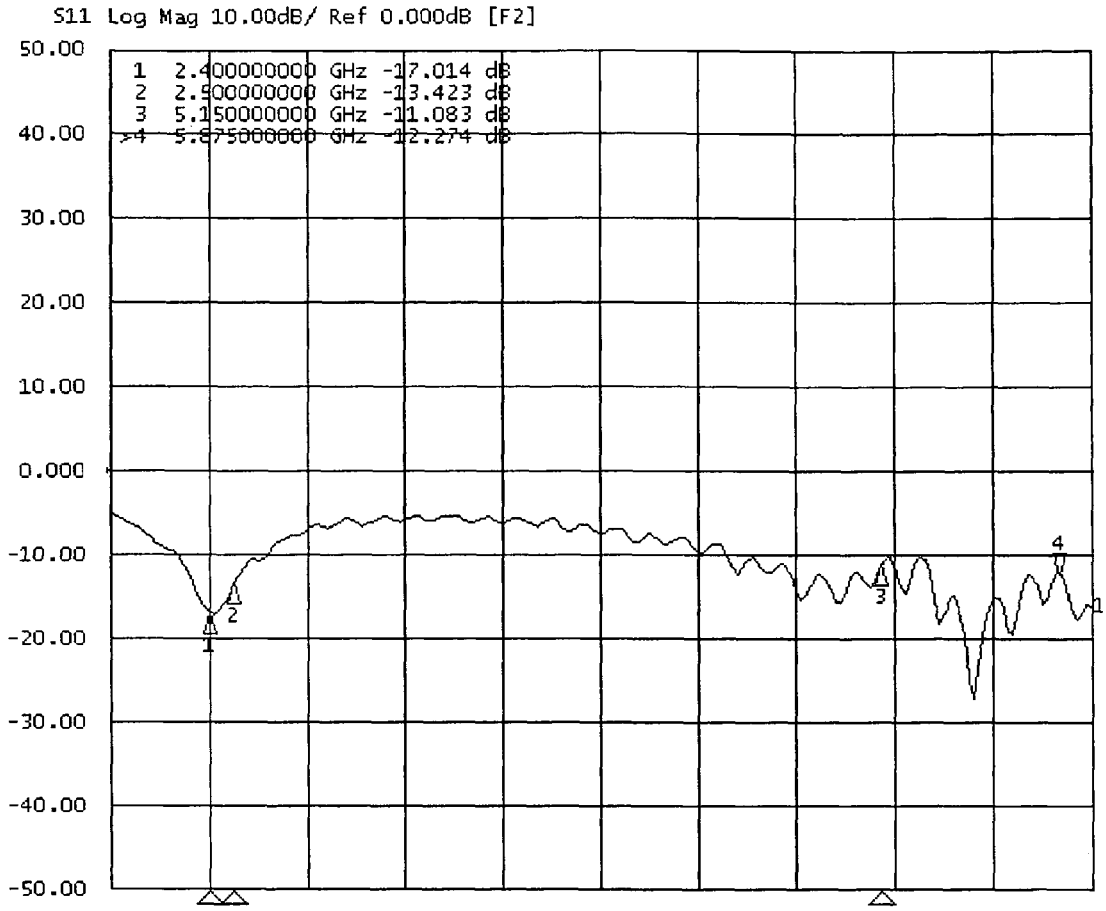
FIG. 2(PRIOR ART)
FIG. 2 (Prior Art) is a return loss vs. frequency curve diagram of the antenna module of FIG. 1.
Figure 3A:
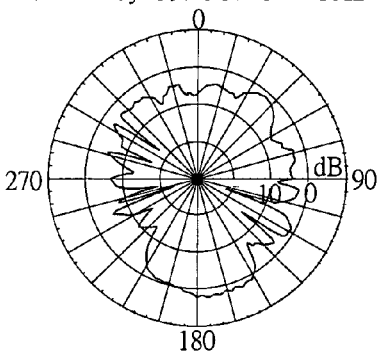
FIG. 3A(PRIOR ART)
FIGS. 3A~3K (Prior Art) are diagrams of far-field power distribution of the antenna module of FIG. 1 on X-Y plane.
Figure 3B:
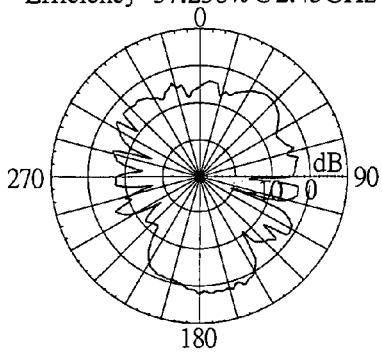
FIG. 3B(PRIOR ART)
Figure 3C:
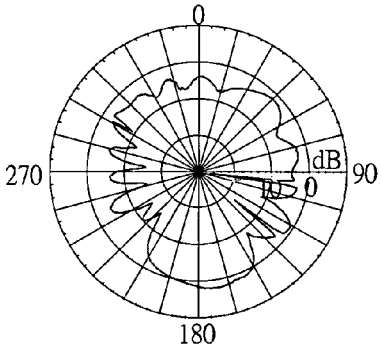
FIG. 3C(PRIOR ART)
Figure 3D:
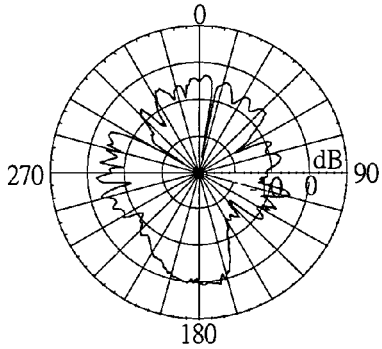
FIG. 3D(PRIOR ART)
Figure 3E:
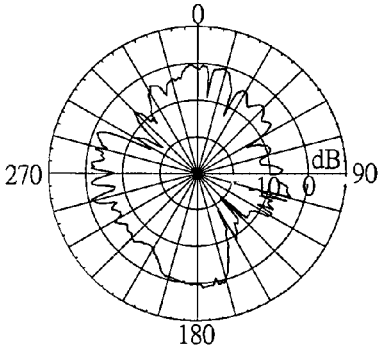
FIG. 3E(PRIOR ART)
Figure 3F:
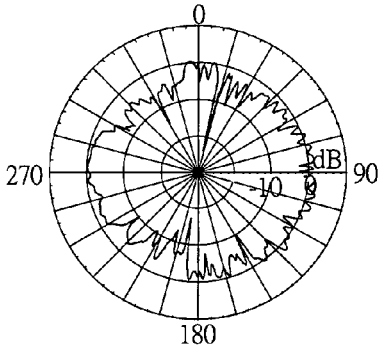
FIG. 3F(PRIOR ART)
Figure 3G:
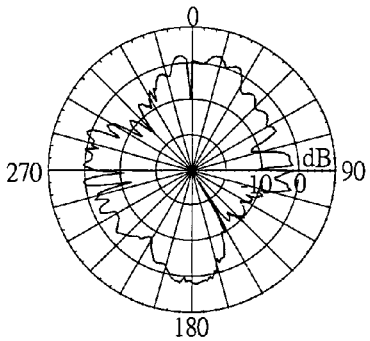
FIG. 3G(PRIOR ART)
Figure 3H:
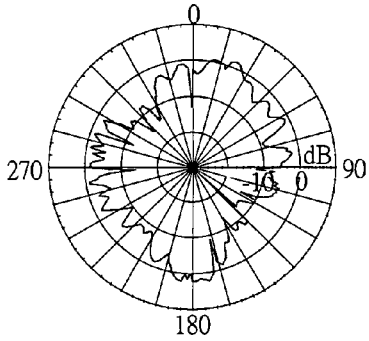
FIG. 3H(PRIOR ART)
Figure 3I:
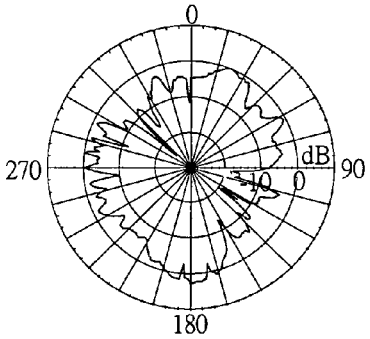
FIG. 3I(PRIOR ART)
Figure 3J:
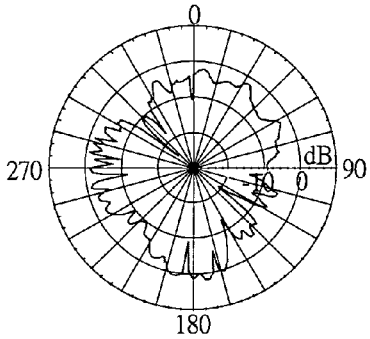
FIG. 3J(PRIOR ART)
Figure 3K:
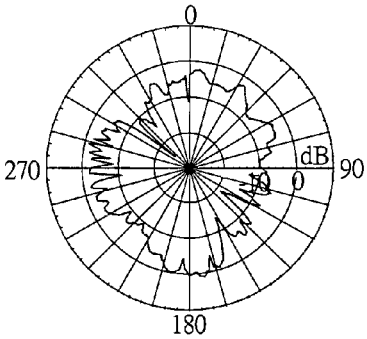
FIG. 3K(PRIOR ART)
Figure 4A:
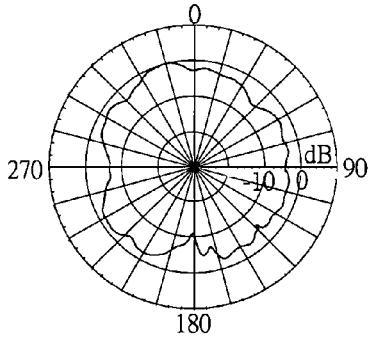
FIG. 4A(PRIOR ART)
FIGS. 4A~4K (Prior Art) are diagrams of far-field power distribution of the antenna module of FIG. 1 on Y-Z plane.
Figure 4B:
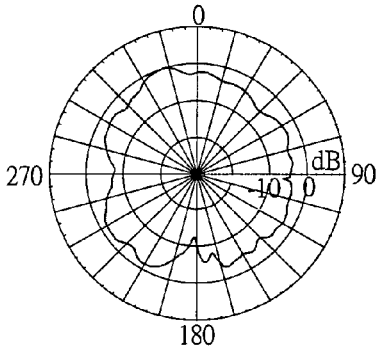
FIG. 4B(PRIOR ART)
Figure 4C:
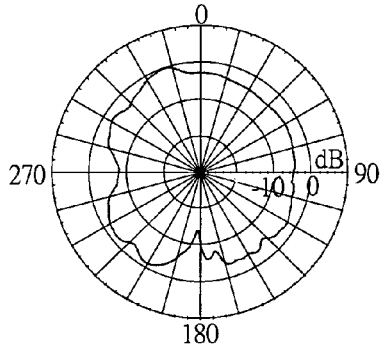
FIG. 4C(PRIOR ART)
Figure 4D:
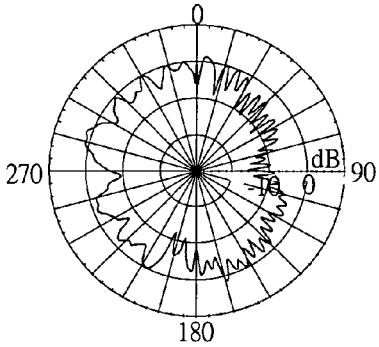
FIG. 4D(PRIOR ART)
Figure 4E:
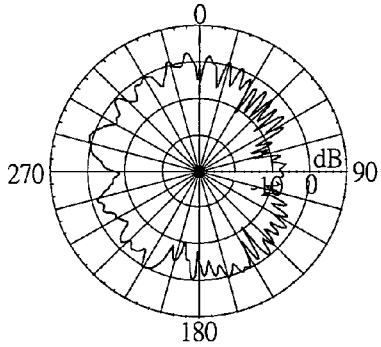
FIG. 4E(PRIOR ART)
Figure 4F:
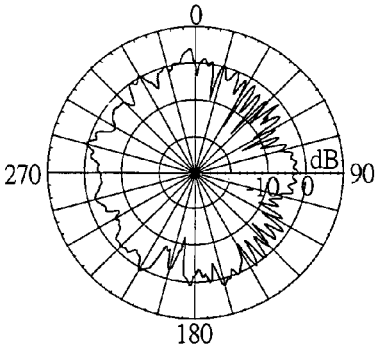
FIG. 4F(PRIOR ART)
Figure 4G:
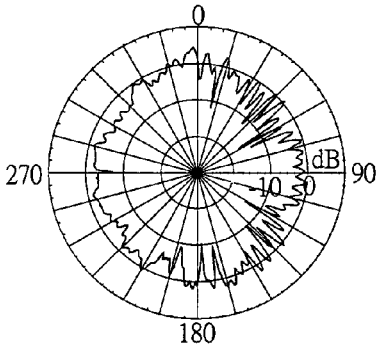
FIG. 4G(PRIOR ART)
Figure 4H:
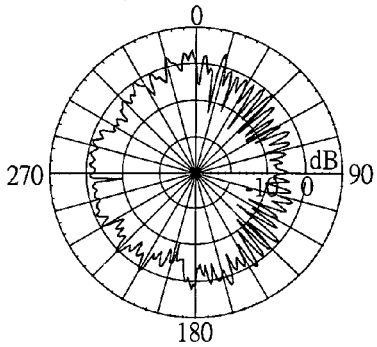
FIG. 4H(PRIOR ART)
Figure 4I:
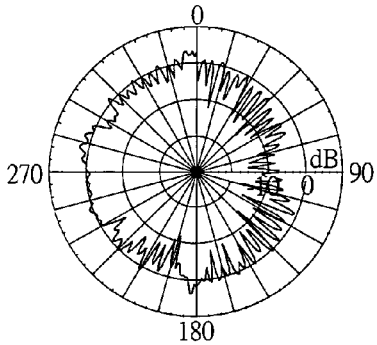
FIG. 4I(PRIOR ART)
Figure 4J:
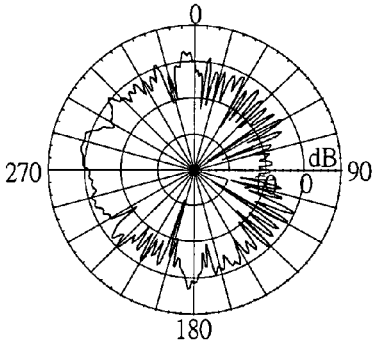
FIG. 4J(PRIOR ART)
Figure 4K:
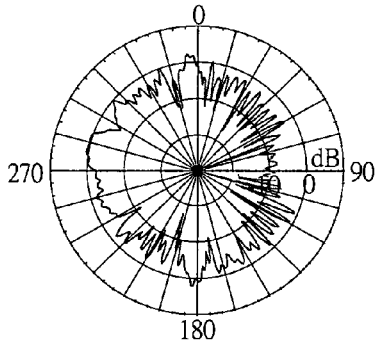
FIG. 4K(PRIOR ART)
Figure 5A:
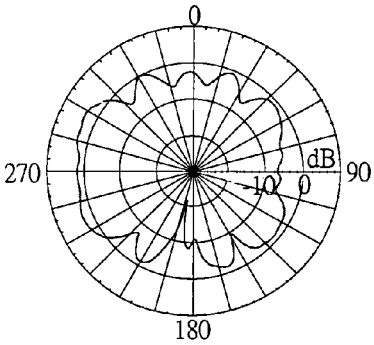
FIG. 5A(PRIOR ART)
FIGS. 5A~5K (Prior Art) are diagrams of far-field power distribution of the antenna module of FIG. 1 on Z-X plane.
Figure 5B:
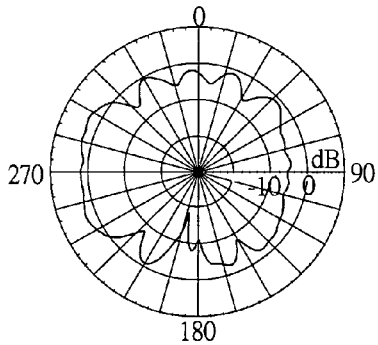
FIG. 5B(PRIOR ART)
Figure 5C:
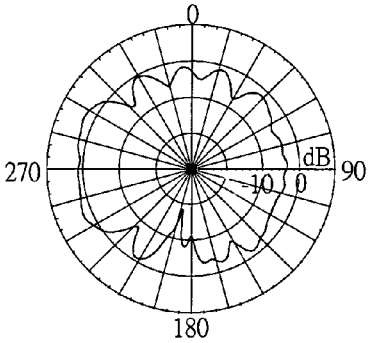
FIG. 5C(PRIOR ART)
Figure 5D:
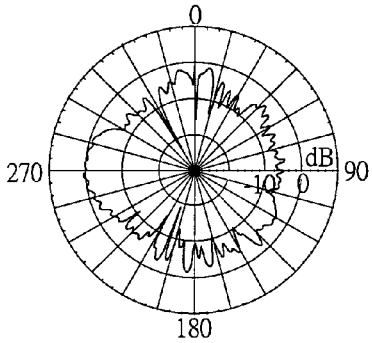
FIG. 5D(PRIOR ART)
Figure 5E:
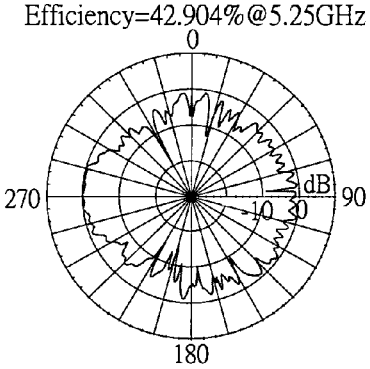
FIG. 5E(PRIOR ART)
Figure 5F:
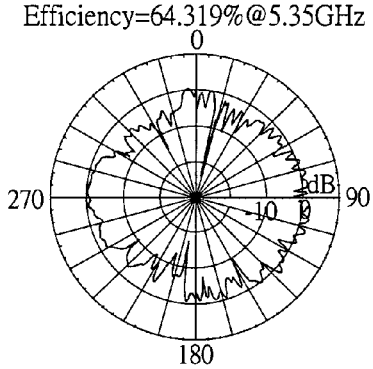
FIG. 5F(PRIOR ART)
Figure 5G:
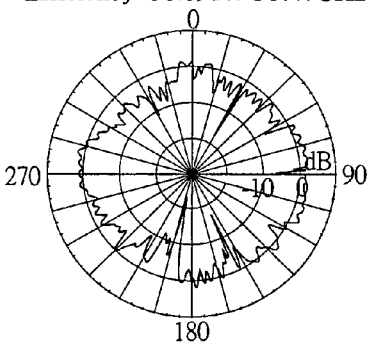
FIG. 5G(PRIOR ART)
Figure 5H:
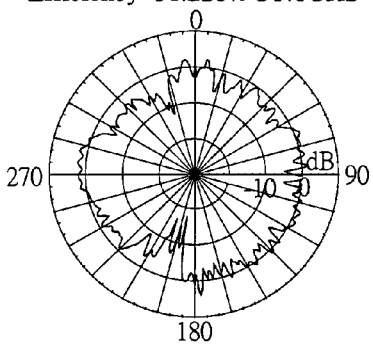
FIG. 5H(PRIOR ART)
Figure 5I:
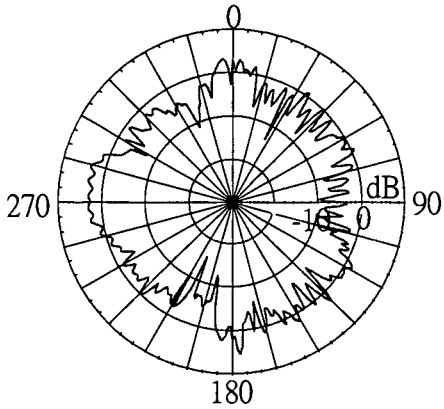
FIG. 5I(PRIOR ART)
Figure 5J:
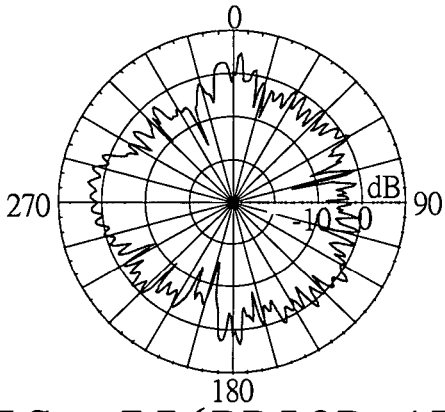
FIG. 5J(PRIOR ART)
Figure 5K:
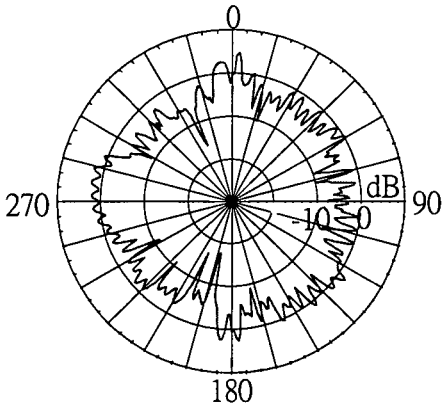
FIG. 5K(PRIOR ART)
Figure 6:
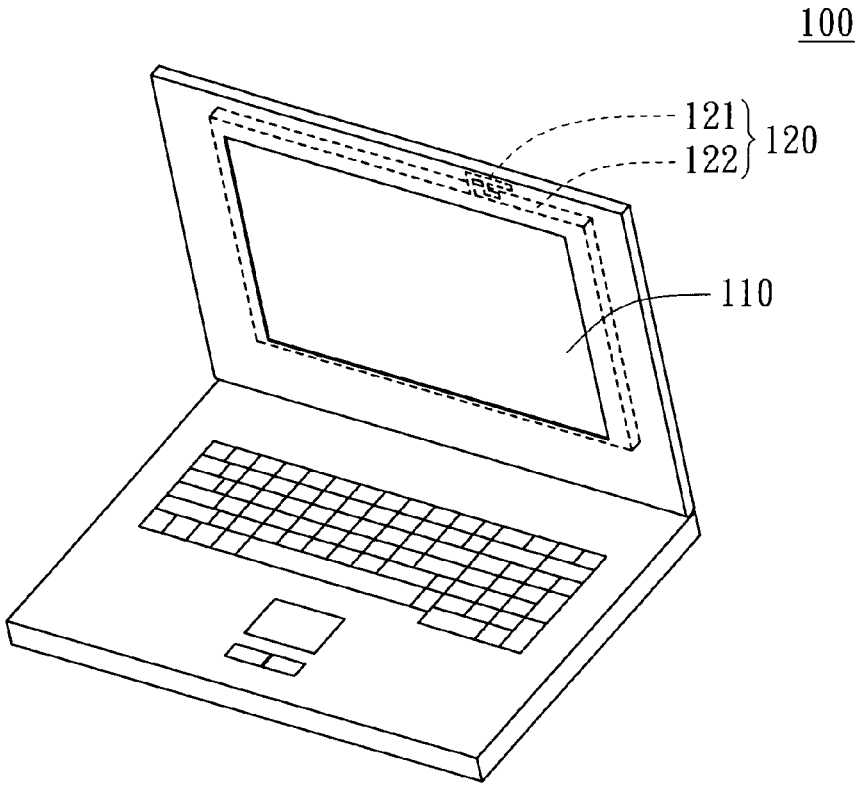
FIG. 6 is a perspective of an electronic device and an antenna module thereof according to a first embodiment of the invention.

Referring to FIG. 6, a perspective of an electronic device 100 and an antenna module 120 according to a first embodiment of the invention is shown. The electronic device 100 includes a plurality of electronic elements 110 and an antenna module 120. Examples of the electronic device 100 include notebook computer (NB), personal digital assistant (PDA), mobile phone, global positioning system (GPS) reception device and ultra mobile personal computer (UMPC). In the present embodiment of the invention, the electronic device 100 is exemplified by a notebook computer, but the variety of the electronic device 100 is not for limiting the invention. The antenna module 120 includes a radiating body 121 and a grounding body 122. The grounding body 122 covers the electronic element 110 for being a shielding casing of the electronic element 110. At least a radio frequency resonance is excited between the radiating body 121 and the grounding body 122.

Let the notebook computer be taken for example. The antenna module 120 directly covers the shielding casing of the electronic element 110 (such as a display panel) for being a grounding body 122. The shielding casing avoids external noise (such as a high frequency electromagnetic wave) interfering the electronic element 110 and also prevents the electromagnetic energy of the electronic element 110 from leaking, such that the electronic element 110 conforms to a certain standard of electromagnetic interference (EMI) and electromagnetic susceptibility (EMS).

The area of the grounding body 122 used as a shielding casing is more than double of the area of the radiating body 121, so the grounding body 122 used as a shielding casing provides the antenna module 120 with excellent grounding properties. Let the notebook computer be taken for example. The shielding casing almost covers the entire display panel. The area of the grounding body 122 used as a shielding casing is more than four times or even ten times of the area of the radiating body 121. When external noises enter the antenna module 120, the large-sized grounding body 122 effectively suppress the generation of noise current, hence minimizing the interference of external noises on the antenna module 120.

Furthermore, the radiating body 121 and the grounding body 122 are integrally formed in one piece in the antenna module 120. As the grounding body 122 used as a shielding casing is no more shielded by the shielding casing, the efficiency of the antenna module 120 is not affected.

When manufacturing the shielding casing, the radiating body 121 and the grounding body 122 of the antenna module 120 are formed at the same time, and the integration between the radiating body 121 and the grounding body 122 is not subjected to assembly tolerance.

Figure 7:
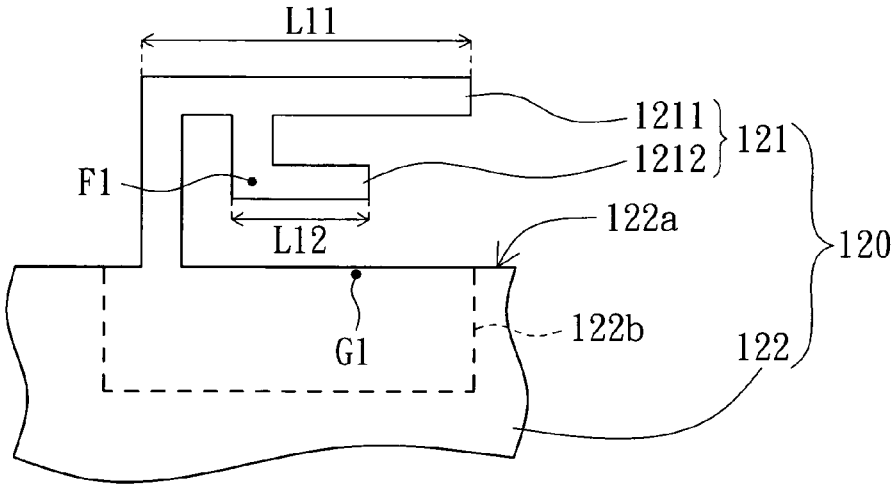
FIG. 7 is an enlargement of the antenna module of FIG. 6.

Referring to FIG. 7, an enlargement of the antenna module 120 of FIG. 6 is shown. In terms of the disposition of the antenna module 120, the radiating body 121 is protruded from a lateral side 122*a* of the grounding body 122. The grounding body 122 having a radiation heat area 122*b* neighboring the radiating body 121 is surrounded by the radiation heat area 122*b* but not any other part of the grounding body 122. The radio frequency resonance excited between the radiating body 121 and the radiation heat area 122*b* of the grounding body 122 will not be affected by the grounding body 122.

Examples of the antenna module 120 include monopole antenna, inverse F antenna (IFA), patched inverse F antenna (PIFA) and slot antenna for example. In the present embodiment of the invention, the antenna module 120 is exemplified by a patched inverse F antenna (PIFA).

The radiating body 121 includes a first sub-radiating body 1211 and a second sub-radiating body 1212. The first sub-radiating body 1211 is connected to the grounding body 122. The first sub-radiating body 1211 has a first length L11. The second sub-radiating body 1212 is connected to the first sub-radiating body 1211 and disposed between the first sub-radiating body 1211 and the grounding body 122. The second sub-radiating body 1212 has a second length L12 smaller than the first length L11.

The radiating body 121 has a feed-in point F1. The grounding body 122 has a grounding point G1. At least a first radio frequency resonance is excited between the first sub-radiating body 1211 and the grounding body 122, and a second the radio frequency resonance is excited between the second sub-radiating body 1212 and the grounding body 122. In the present embodiment of the invention, the first radio frequency resonance is a frequency band of 2.4 GHz used in 802.11b or 802.11g communication protocol, and the second the radio frequency resonance is a frequency band of 5 GHz used in 802.11a communication protocol.

Figure 8:
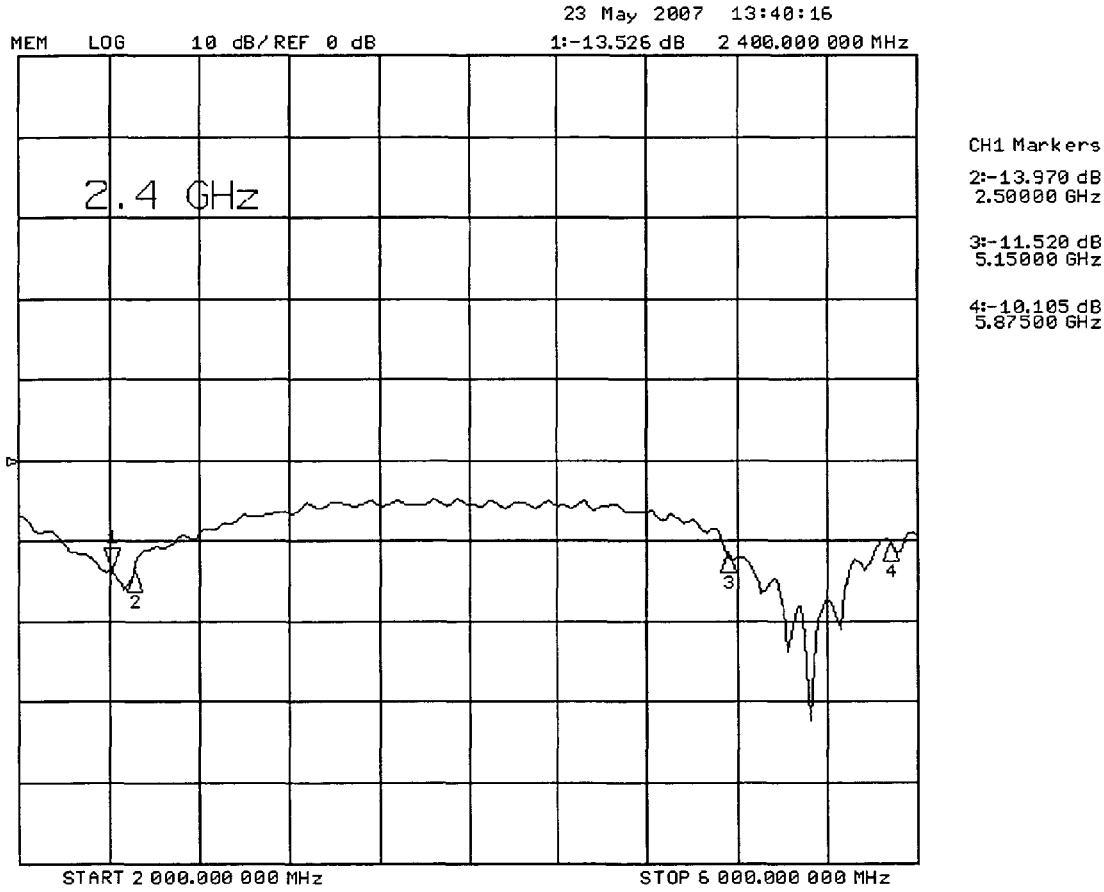
FIG. 8 is a return loss vs. frequency curve diagram of the antenna module of FIG. 6.
Figure 9A:
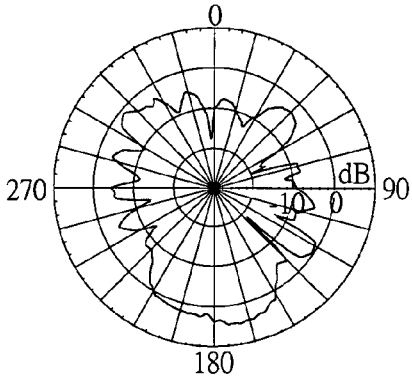
FIGS. 9A~9K are diagrams of far-field power distribution of the antenna module of FIG. 6 on X-Y plane.
Figure 9B:
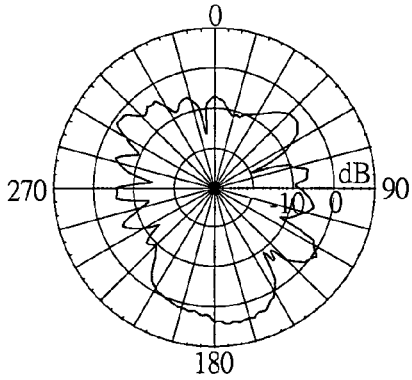
Figure 9C:
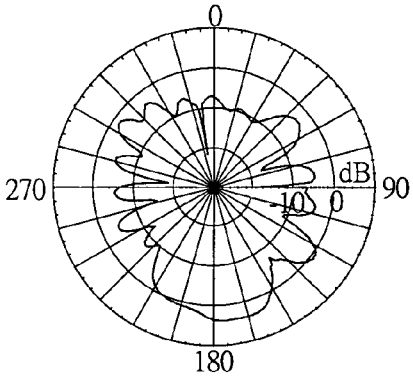
Figure 9D:
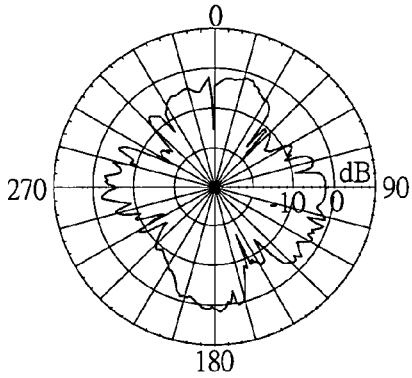
Figure 9E:
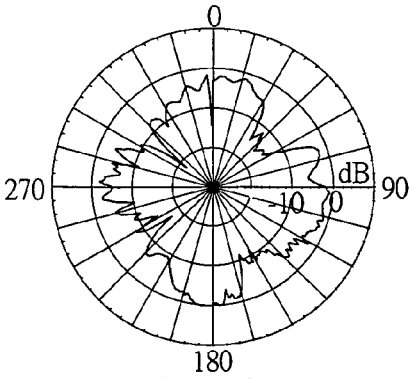
Figure 9F:
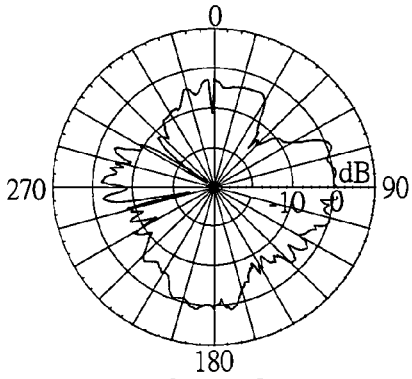
Figure 9G:
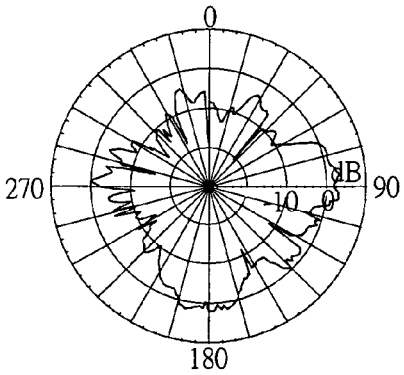
Figure 9H:
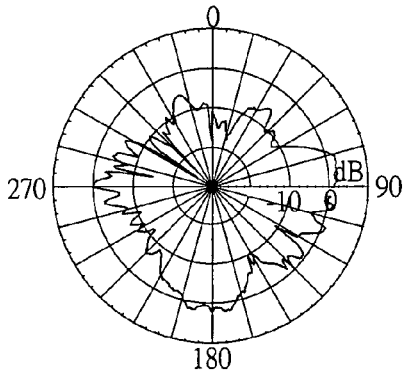
Figure 9I:
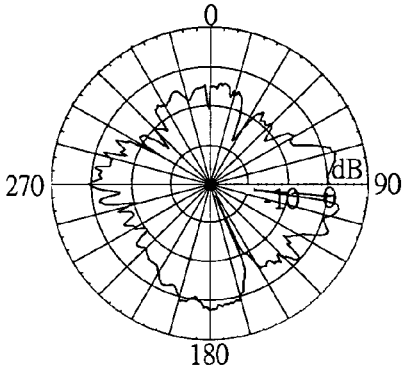
Figure 9J:
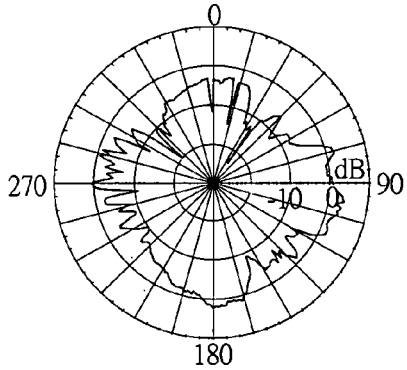
Figure 9K:
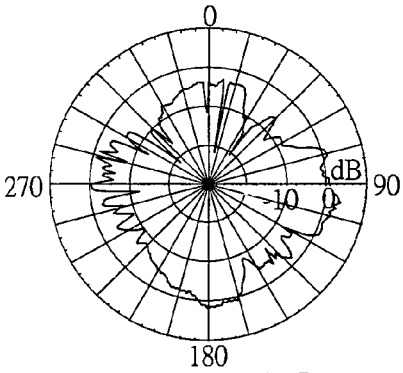
Figure 10A:
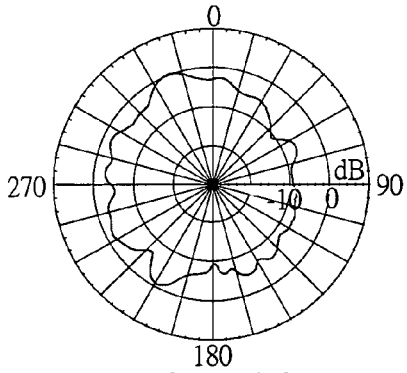
FIGS. 10A~10K are diagrams of far-field power distribution of the antenna module of FIG. 6 on Y-Z plane.
Figure 10B:
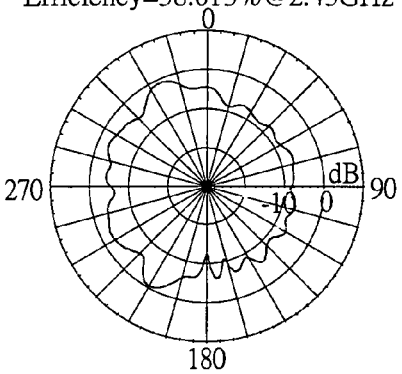
Figure 10C:
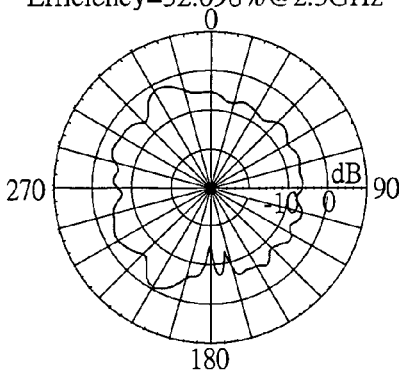
Figure 10D:
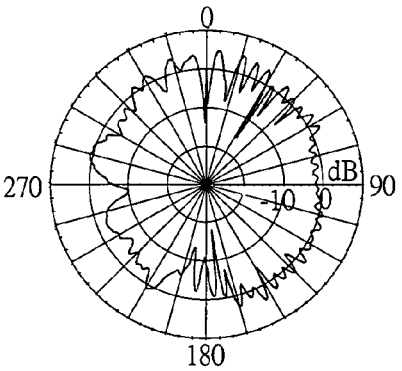
Figure 10E:
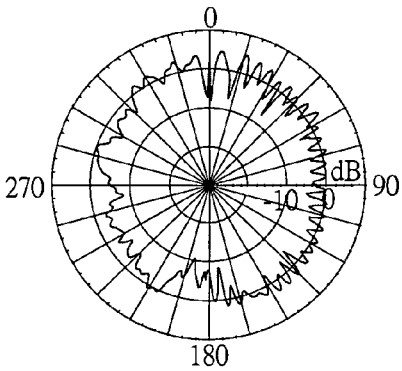
Figure 10F:
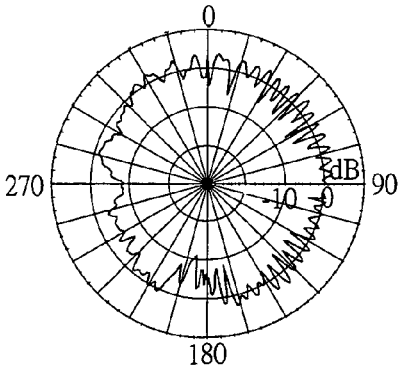
Figure 10G:
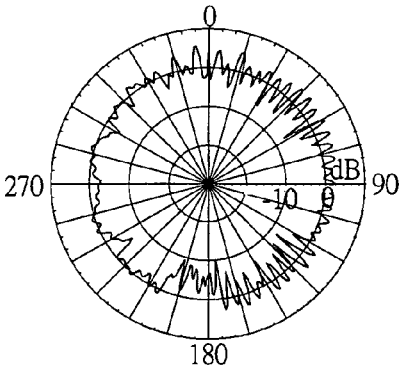
Figure 10H:
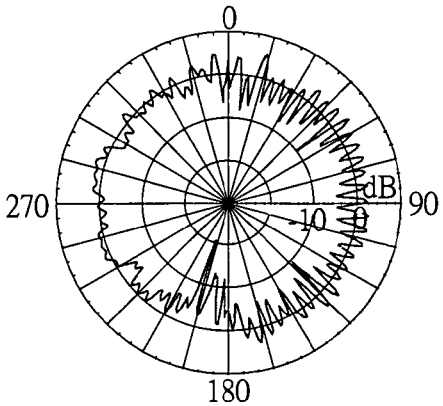
Figure 10I:
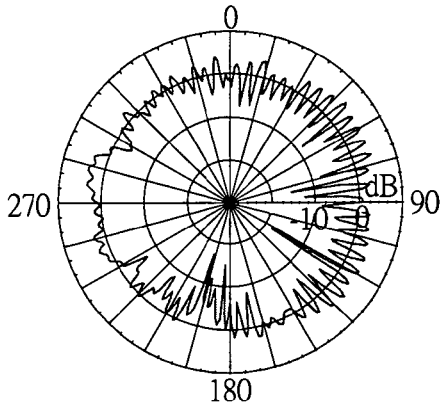
Figure 10J:
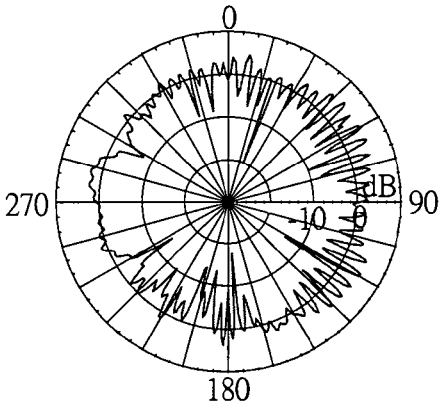
Figure 10K:
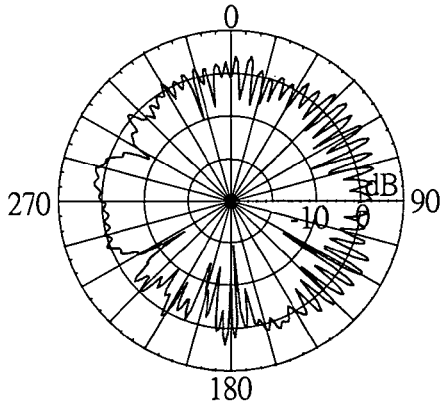
Figure 11A:
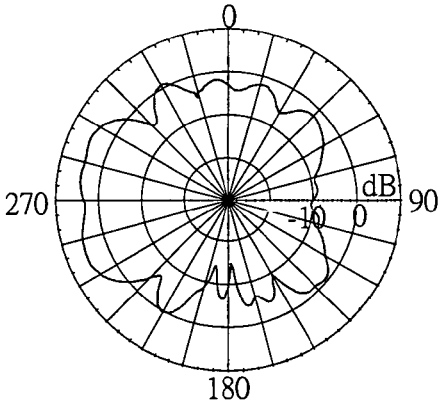
FIGS. 11A~11K are diagrams of far-field power distribution of the antenna module of FIG. 6 on Z-X plane.
Figure 11B:
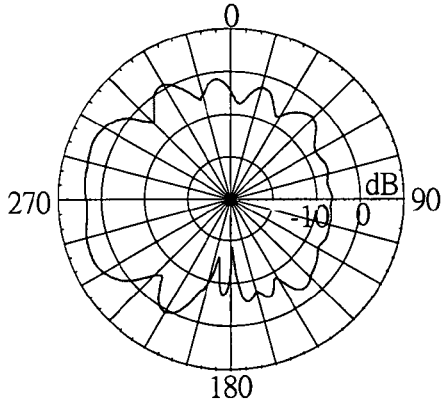
Figure 11C:
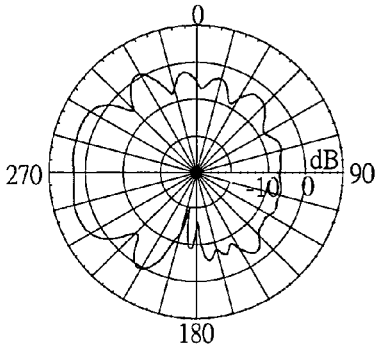
Figure 11D:
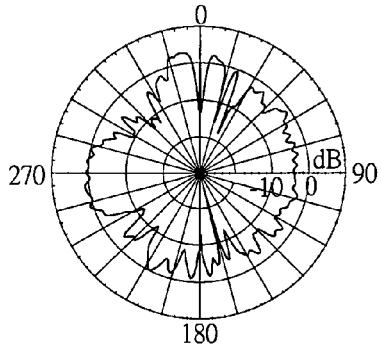
Figure 11E:
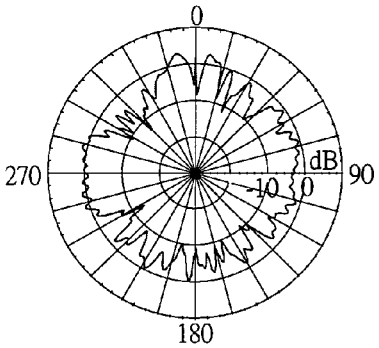
Figure 11F:
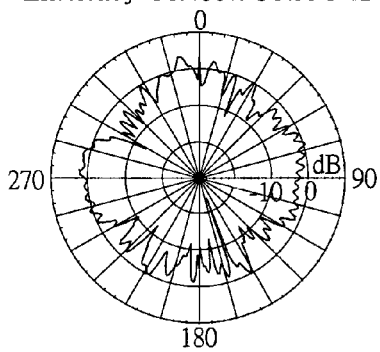
Figure 11G:
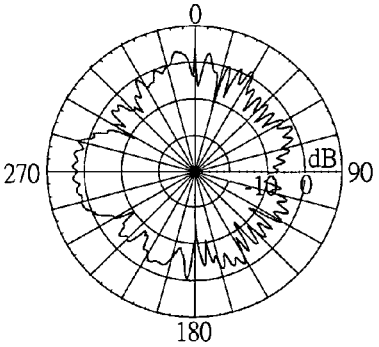
Figure 11H:
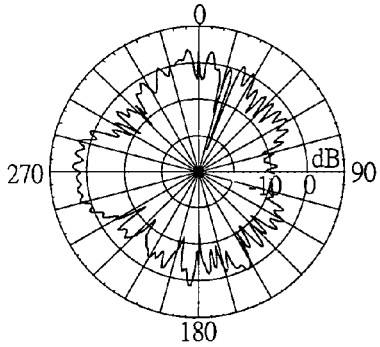
Figure 11I:
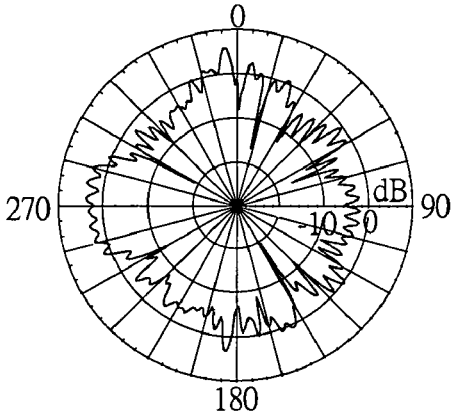
Figure 11J:
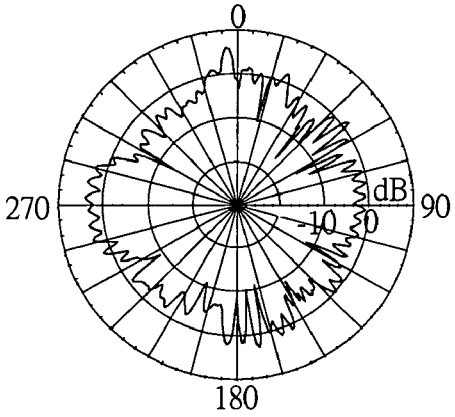
Figure 11K:
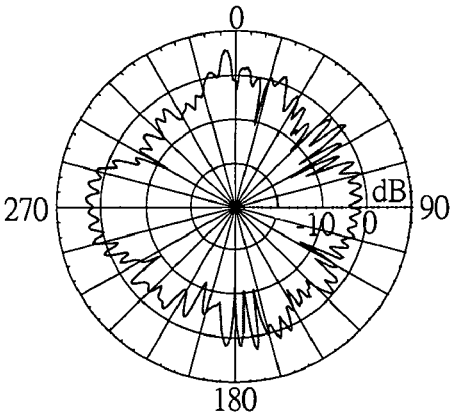

Referring to FIG. 8, FIGS. 9A~9K, FIGS. 10A~10K and FIGS. 11A~11K. FIG. 8 is a return loss vs. frequency curve diagram of the antenna module 120 of FIG. 6. FIGS. 9A~9K are diagrams of far-field power distribution of the antenna module 120 of FIG. 6 on X-Y plane. FIG. 10A~10K are diagrams of far-field power distribution of the antenna module 120 of FIG. 6 on Y-Z plane. FIG. 11A~11K are diagrams of far-field power distribution of the antenna module 120 of FIG. 6 on Z-X plane. According to the experimental results, the return loss, the radiation efficiency, the peak gain and the average gain at each frequency band are respectively shown in Table 2.1~Table 2.6:

TABLE 2.1

| | Return Loss | | | |
|---|---|---|---|---|
| Frequency Band (GHz) | 2.4 | 2.5 | 5.15 | 5.875 |
| Measurement Result | 13.526 | 13.970 | 11.520 | 10.105 |

As indicated in Table 2.1, when the antenna module 120 is at the frequency band of 2.4 GHz, 2.5 GHz, 5.15 GHz and 5.875 GHz, the return loss has a maximum value of 13.970 dBi and a minimum of 10.105 dBi, and the difference between the two return losses is 3.865 dBi. Compared with the conventional antenna module 920 whose return loss differ by 5.931 dBi, the experiment results show that the antenna module 120 is capable of effectively reducing the influence of the shielding casing and increasing anti-noise ability, so the antenna module 120 has a uniform distribution of return loss at different frequency bands.

TABLE 2.2

| Radiation Efficiency | |
|---|---|
| Frequency | Radiation Efficiency |
| 2.400 GHz | 62.77 |
| 2.450 GHz | 58.01 |
| 2.500 GHz | 52.09 |
| 5.150 GHz | 43.18 |
| 5.250 GHz | 48.43 |
| 5.350 GHz | 56.46 |
| 5.470 GHz | 53.33 |
| 5.600 GHz | 57.37 |
| 5.725 GHz | 58.38 |
| 5.825 GHz | 61.15 |
| 5.850 GHz | 56.91 |

As indicated in Table 2.2, of the 11 points measured when the antenna module 120 is at the frequency band of 2.4 GHz~5.85 GHz, the radiation efficiency has a maximum value of 62.77% and a minimum value of 43.18%, and the difference between the maximum and the minimum radiation efficiency is 19.59%. For ordinary radiation efficiency, the acceptable minimum level is 45%. However, in the above frequency bands, there is only one frequency band (5.15 GHz) whose radiation efficiency is lower than the minimum level. Compared with the conventional antenna module 920, (the difference between the maximum and the minimum radiation efficiency is 31.57%, and there are three frequency bands whose radiation efficiency is lower than the minimum level), the experiment results show that the antenna module 120 is capable of effectively reducing the influence of the shielding casing and increasing anti-noise ability, such the antenna module 120 has a uniform distribution of radiation frequency at different frequency bands and lesser number of frequency bands having low radiation efficiency.

TABLE 2.3

| | Peak Gain (dBi) | | | | | |
|---|---|---|---|---|---|---|
| | Frequency Band (GHz) | | | | | |
| | 2.4 | 2.45 | 2.5 | 5.15 | 5.25 | 5.35 |
| X-Y | 5.47 | 4.76 | 3.96 | 4.05 | 4.44 | 3.71 |
| Y-Z | | | | | | |
| Z-X | | | | | | |

TABLE 2.4

| | Peak Gain (dBi) | | | | |
|---|---|---|---|---|---|
| | Frequency Band (GHz) | | | | |
| | 5.47 | 5.6 | 5.725 | 5.825 | 5.85 |
| X-Y | 5.64 | 5.41 | 6.52 | 7.83 | 7.62 |
| Y-Z | | | | | |
| Z-X | | | | | |

As indicated in Table 2.3~2.4, of the 11 points measured when the antenna module 220 is at the frequency band of 2.4 GHz~5.85 GHz, the peak gain has a maximum value of 7.83 dBi and a minimum value of 3.71 dBi, and the difference between the maximum and the minimum gain is 4.12 dBi. The experiment results show that the antenna module 120 is capable of effectively reducing the influence of the shielding casing and increasing anti-noise ability, such that the antenna module has a uniform distribution of peak gain at different frequency bands.

TABLE 2.5

| | Average Gain (dBi) | | | | |
|---|---|---|---|---|---|
| | Frequency Band (GHz) | | | | |
| | 2.4 | 2.45 | 2.5 | 5.15 | 5.25 |
| X-Y | −4.33 | −4.44 | −4.53 | −5.62 | −5.73 |
| Y-Z | −5.02 | −5.70 | −5.68 | −1.47 | −1.17 |
| Z-X | −1.82 | −2.21 | −2.72 | −3.80 | −3.23 |

TABLE 2.6

| | Average Gain (dBi) | | | | | |
|---|---|---|---|---|---|---|
| | Frequency Band (GHz) | | | | | |
| | 5.35 | 5.47 | 5.6 | 5.725 | 5.825 | 5.85 |
| X-Y | −4.83 | −4.82 | −5.00 | −4.30 | −4.11 | −4.43 |
| Y-Z | −1.31 | −0.60 | −0.82 | −0.52 | −0.64 | −0.94 |
| Z-X | −3.02 | −3.19 | −3.40 | −2.83 | −2.39 | −2.67 |

As indicated in Table 2.5~2.6, of the 11 X-Y plane points measured when the antenna module 120 is at the frequency band of 2.4 GHz~5.85 GHz, the average gain has a maximum value of −5.73 dBi and a minimum value of −4.11 dBi, and the difference between the maximum and the minimum average gain is 1.62 dBi. Compared with the conventional antenna module 920 whose average gains differ by 3.04 dBi, the experiment results show that the antenna module 120 is capable of effectively reducing the influence of the shielding casing and increasing anti-noise ability, such that the antenna module 120 has a uniform distribution of average gain at different frequency bands.

Second Embodiment

Figure 12:
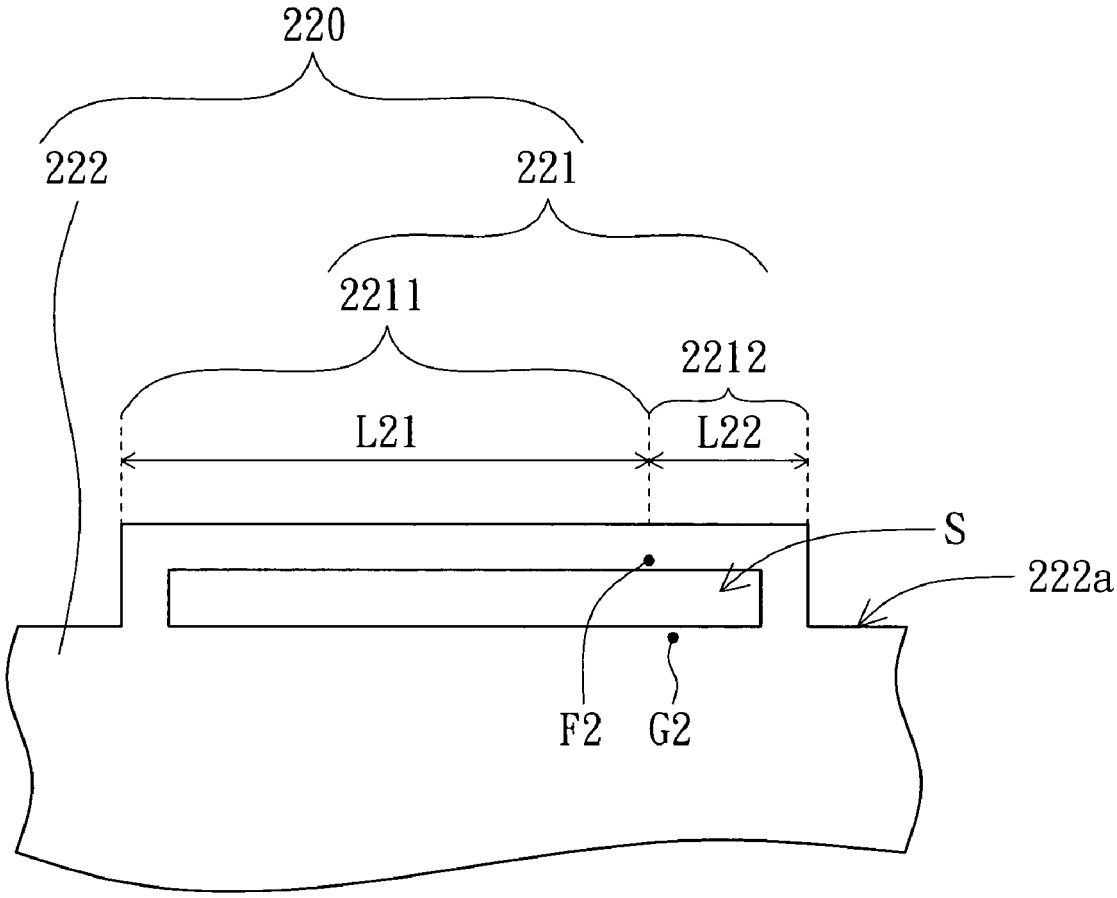
FIG. 12 is a perspective of an antenna module thereof according to a second embodiment of the invention.

Referring to FIG. 12, a perspective of and an antenna module 220 thereof according to a second embodiment of the invention is shown. The antenna module 220 of the present embodiment of the invention differs with the antenna module 120 of the first embodiment in that the antenna module 220 is exemplified by a slot antenna. As for other similarities, the same designations are used and are not repeated here.

The antenna module 220 has a groove S disposed between the radiating body 221 and the grounding body 222. The radiating body 221 includes a first sub-radiating body 2211 and a second sub-radiating body 2212. The first sub-radiating body 2211 is connected to the grounding body 222. The first sub-radiating body 2211 has a first length L21. The second sub-radiating body 2212 is connected to the grounding body 222 and the first sub-radiating body 2211. The second sub-radiating body 2212 has a second length L22 smaller than the first length L21.

The radiating body 221 has a feed-in point F2 disposed at the junction between the first sub-radiating body 2211 and the second sub-radiating body 2212. The grounding body 222 has a grounding point G2 neighboring a lateral side 222*a* of the radiating body 221. At least a first radio frequency resonance is excited between the first sub-radiating body 2211 and the grounding body 222, and a second the radio frequency resonance is excited between the second sub-radiating body 2212 and the grounding body 222. In the present embodiment of the invention, the first radio frequency resonance is a frequency band of 2.4 GHz used in 802.11b or 802.11g communication protocol, the second the radio frequency resonance is a frequency band of 5 GHz used in 802.11a communication protocol.

Figure 13:
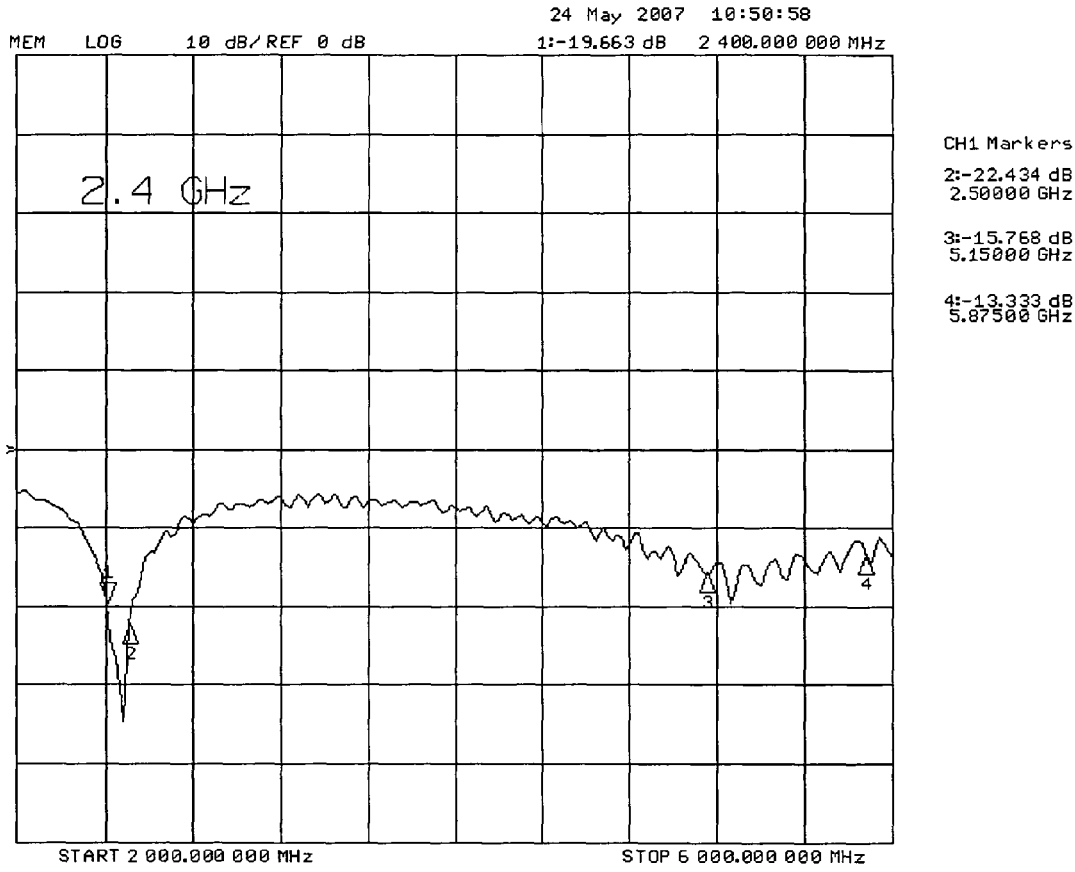
FIG. 13 is a return loss vs. frequency curve diagram of the antenna module of FIG. 12.
Figure 14A:
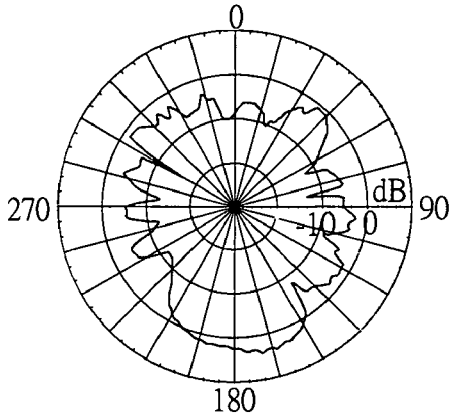
FIGS. 14A~14K are diagrams of far-field power distribution of the antenna module of FIG. 12 on X-Y plane.
Figure 14B:
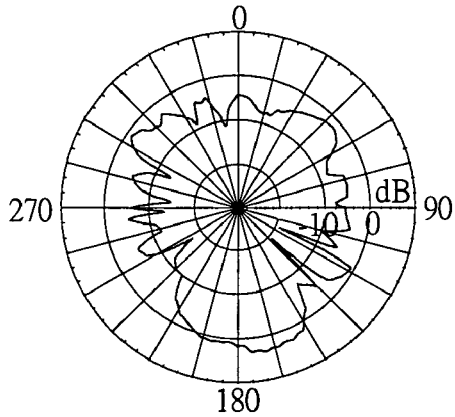
Figure 14C:
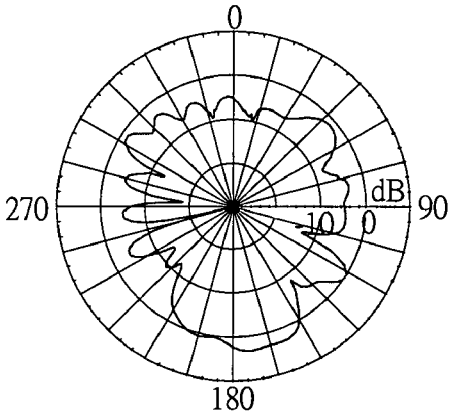
Figure 14D:
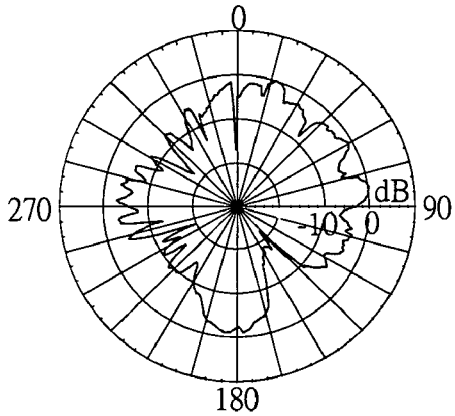
Figure 14E:
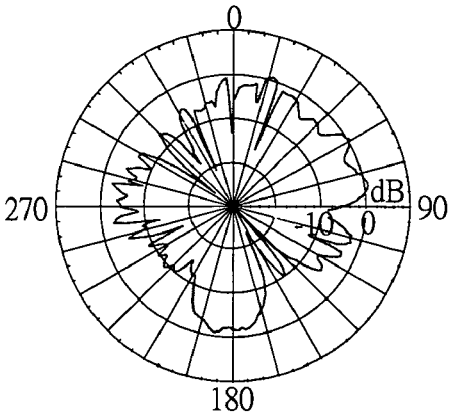
Figure 14F:
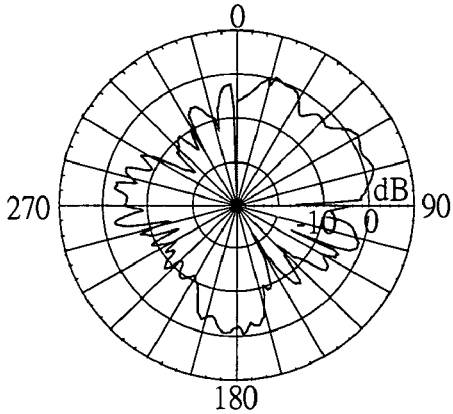
Figure 14G:
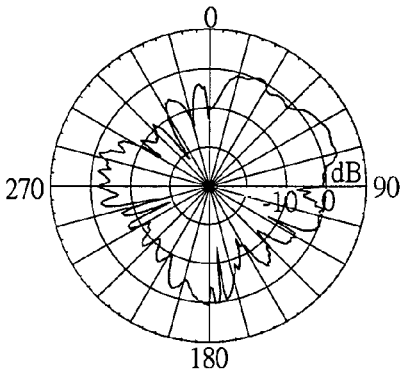
Figure 14H:
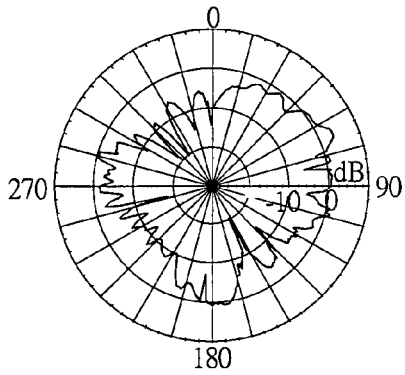
Figure 14I:
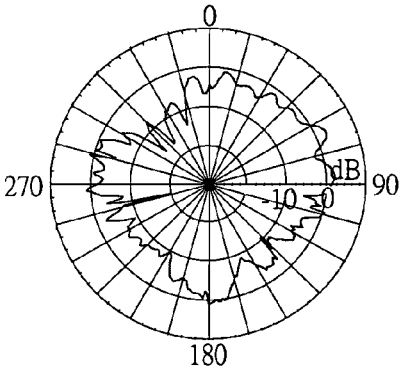
Figure 14J:
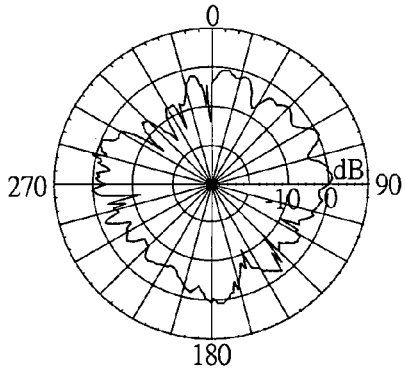
Figure 14K:
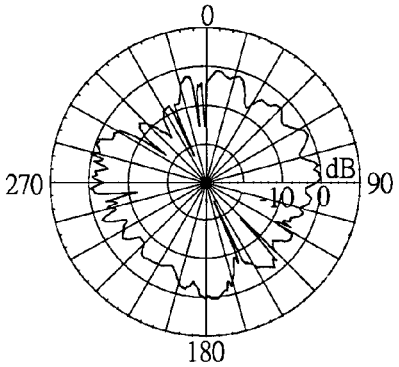
Figure 15A:
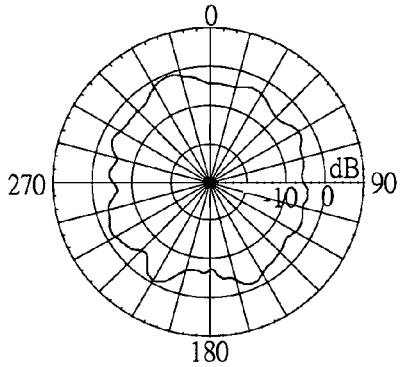
FIG. 15A~15K are diagrams of far-field power distribution of the antenna module of FIG. 12 on Y-Z plane.
Figure 15B:
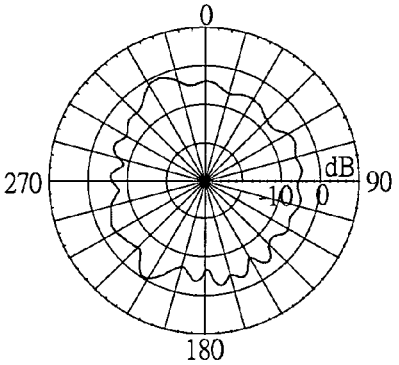
Figure 15C:
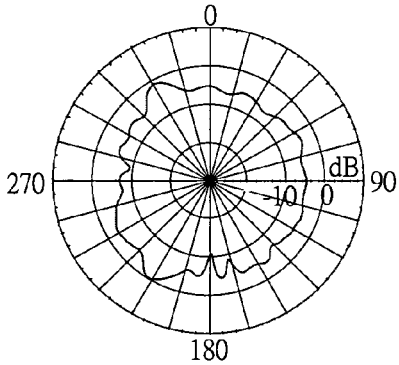
Figure 15D:
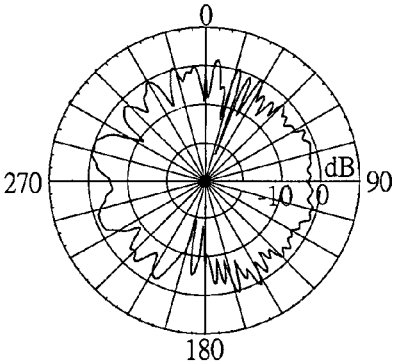
Figure 15E:
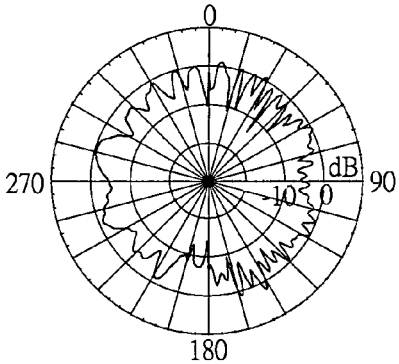
Figure 15F:
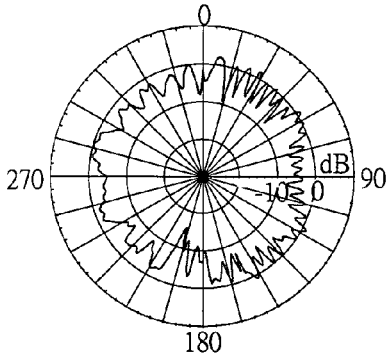
Figure 15G:
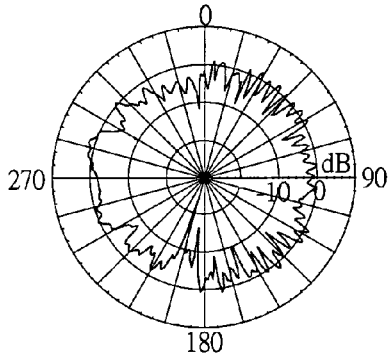
Figure 15H:
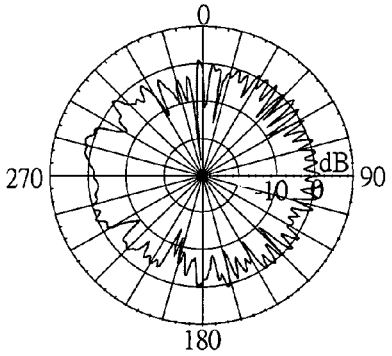
Figure 15I:
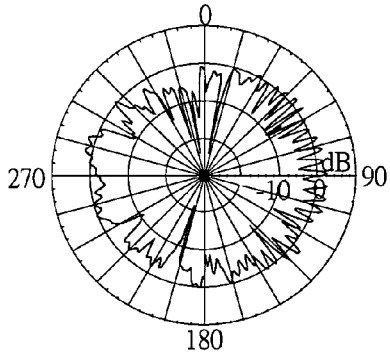
Figure 15J:
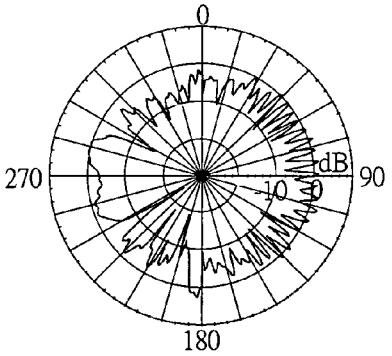
Figure 15K:
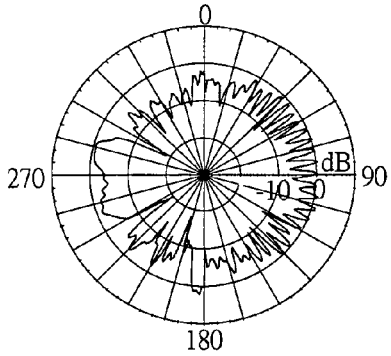
Figure 16A:
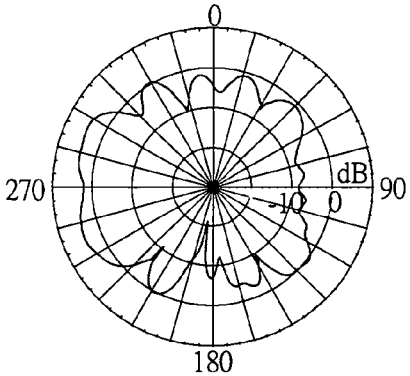
FIGS. 16A~16K are diagrams of far-field power distribution of the antenna module of FIG. 12 on Z-X plane.
Figure 16B:
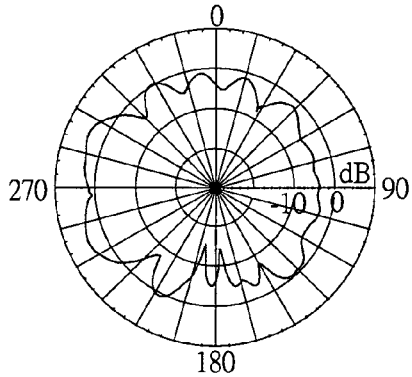
Figure 16C:
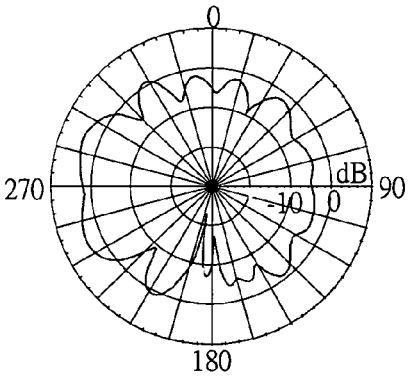
Figure 16D:
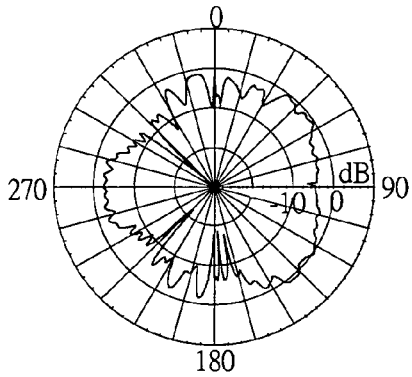
Figure 16E:
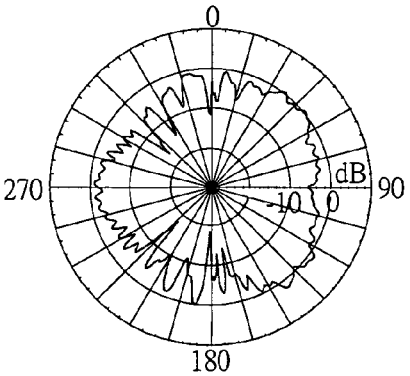
Figure 16F:
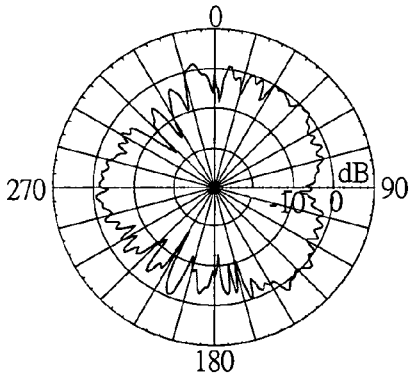
Figure 16G:
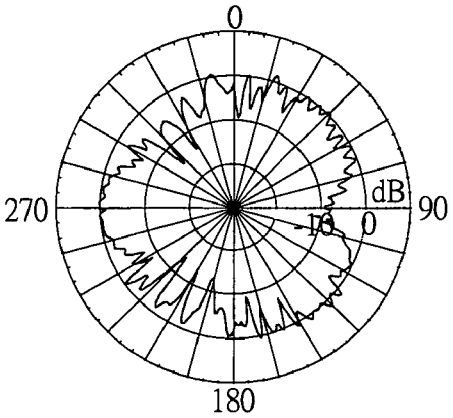
Figure 16H:
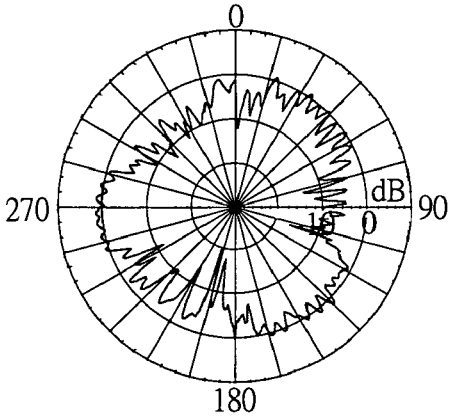
Figure 16I:
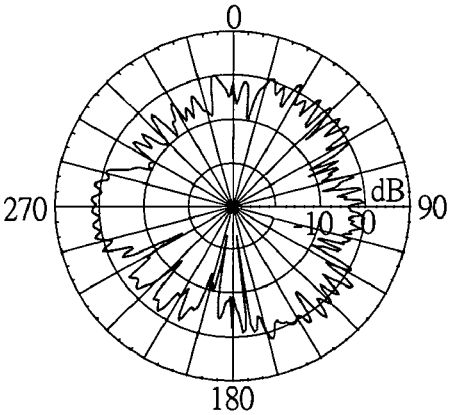
Figure 16J:
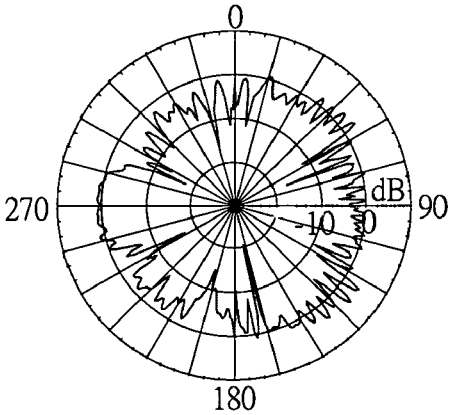
Figure 16K:
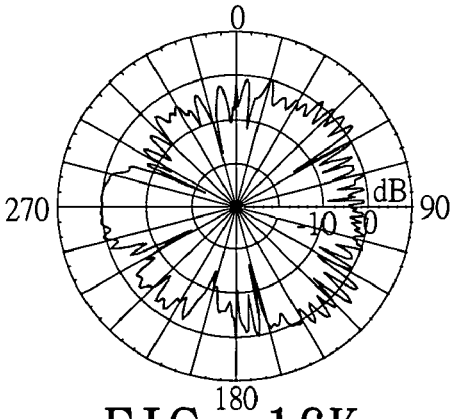

Referring to FIG. 13, FIG. 14A~14K, FIG. 15A~15K and FIG. 16A~16K. FIG. 13 is a return loss vs. frequency curve diagram of the antenna module 220 of FIG. 12. FIGS. 14A~14K are diagrams of far-field power distribution of the antenna module 220 of FIG. 12 on X-Y plane. FIGS. 15A~15K are diagrams of far-field power distribution of the antenna module 220 of FIG. 12 on Y-Z plane. FIGS. 16A~16K are diagrams of far-field power distribution of the antenna module 220 of FIG. 12 on Z-X plane. According to the experimental results, the return loss, the radiation efficiency, the peak gain and the average gain at each frequency band are respectively shown in Table 3.1~Table 3.6:

TABLE 3.1

| | Return Loss | | | |
|---|---|---|---|---|
| Frequency Band (GHz) | 2.4 | 2.5 | 5.15 | 5.875 |
| Measurement Result | 19.663 | 22.434 | 15.768 | 13.333 |

As indicated in Table 3.1, when the antenna module 220 is at the frequency width of 2.4 GHz, 2.5 GHz, 5.15 GHz and 5.875 GHz, the return loss of the antenna module 220 is larger than that of the conventional antenna module 920. Compared with the conventional antenna module 920, the experiment results show that the antenna module 220 is capable of effectively reducing the influence of the shielding casing and increasing anti-noise ability, such that the antenna module 220 has excellent distribution of return loss at different frequency bands.

TABLE 3.2

| Efficiency | |
|---|---|
| Frequency | Radiation Efficiency |
| 2.400 GHz | 64.38 |
| 2.450 GHz | 63.43 |
| 2.500 GHz | 57.51 |
| 5.150 GHz | 44.39 |
| 5.250 GHz | 51.14 |
| 5.350 GHz | 47.26 |
| 5.470 GHz | 53.30 |
| 5.600 GHz | 58.38 |
| 5.725 GHz | 56.91 |
| 5.825 GHz | 71.90 |
| 5.850 GHz | 62.57 |

As indicated in Table 3.2, of the 11 points measured when the antenna module 220 is at the frequency band of 2.4 GHz~5.85 GHz, the radiation efficiency has a maximum value of 71.90% and a minimum value of 44.39%, and the difference between the maximum radiation efficiency and the minimum radiation efficiency is 27.51%. For ordinary radiation efficiency, the acceptable minimum level is 45%. However, in the above frequency bands, there is only one frequency band (5.15 GHz) whose radiation efficiency is lower than the minimum level. Compared with the conventional antenna module 920, (the difference between the maximum and the minimum radiation efficiency is 31.57%, and there are three frequency bands whose radiation efficiencies are lower than the minimum level), the experiment results show that the antenna module 220 is capable of effectively reducing the influence of the shielding casing and increasing anti-noise ability, such that the antenna module 220 has a uniform distribution of radiation frequency at different frequency bands and has lesser frequency bands resulting in low radiation efficiency.

TABLE 3.4

| Peak Gain (dBi) | | | | | |
|---|---|---|---|---|---|
| | Frequency | | | | |
| | 5.47 | 5.6 | 5.725 | 5.825 | 5.85 |
| X-Y | 4.21 | 4.50 | 4.81 | 4.94 | 4.58 |
| Y-Z | | | | | |
| Z-X | | | | | |

As indicated in Table 3.3~3.4, of the 11 points measured when the antenna module 220 is at the frequency band of 2.4 GHz~5.85 GHz, the peak gain has a maximum value of 4.94 dBi and a minimum value of 1.56 dBi, and the difference between the maximum and the minimum peak gain is 3.38 dBi. Compared with the conventional antenna module 920 whose peak gains differ by 4.78 dBi, the experiment results show that the antenna module 220 is capable of effectively reducing the influence of the shielding casing and increasing anti-noise ability, such that the antenna module 220 has a uniform distribution of peak gain at different frequency bands.

TABLE 3.5

| Average Gain (dBi) | | | | | |
|---|---|---|---|---|---|
| | Frequency Band (GHz) | | | | |
| | 2.4 | 2.45 | 2.5 | 5.15 | 5.25 |
| X-Y | −4.10 | −4.40 | −4.14 | −6.14 | −5.70 |
| Y-Z | −4.09 | −4.97 | −5.16 | −3.75 | −3.51 |
| Z-X | −1.91 | −1.87 | −2.23 | −4.48 | −3.65 |

TABLE 3.6

| Average Gain (dBi) | | | | | | |
|---|---|---|---|---|---|---|
| | Frequency Band (GHz) | | | | | |
| | 5.35 | 5.47 | 5.6 | 5.725 | 5.825 | 5.85 |
| X-Y | −5.27 | −4.38 | −4.54 | −4.13 | −4.07 | −4.48 |
| Y-Z | −3.42 | −2.85 | −2.73 | −3.14 | −4.12 | −4.85 |
| Z-X | −3.52 | −3.32 | −3.88 | −3.21 | −2.87 | −3.37 |

As indicated in Table 3.5~3.6, of the 11 X-Y plane points measured when the antenna module 120 is at the frequency band of 2.4 GHz~5.85 GHz, the average gain has a maximum value of −6.14 dBi and a minimum value of −4.07 dBi, and the difference between the maximum and the minimum average gain is 2.07 dBi. Compared with the conventional antenna module 920 whose average gains differ by 3.04 dBi, the experiment results show that the antenna module 220 is capable of effectively reducing the influence of the shielding casing and increasing anti-noise ability, such that the antenna module 120 has a uniform distribution of average gain at different frequency bands.

According to the electronic device and the antenna module thereof disclosed in the above embodiment of the invention, the shielding casing is used as a grounding body of the antenna module, such that the electronic device and the antenna module thereof has many advantages exemplified as follows.

Firstly, the grounding body used as the shielding casing provides the antenna module with excellent grounding properties. When external noises enter the antenna module, large-sized grounding body effectively suppress the generation of noise current, hence minimizing the interference of external noises on the antenna module.

Secondly, the radiating body and the grounding body are integrally formed in one piece in the antenna module. As the grounding body used as a shielding casing is no more shielded by the shielding casing, the efficiency of the antenna module is not affected.

Thirdly, when manufacturing the shielding casing, the radiating body and the grounding body of the antenna module are formed at the same time, and the integration between the radiating body and the grounding body is not subjected to assembly tolerance.

Fourthly, the radiating body is protruded from a lateral side of the grounding body. The grounding body having a radiation heat area neighboring the radiating body 121 is surrounded by the radiation heat area 122*b* but not any other part of the grounding body. The radio frequency resonance excited between the radiating body and the radiation heat area of the grounding body will not be affected by the grounding body.

Fifthly, the invention is applicable to various types of antenna modules.

Sixthly, the experimental results show that the antenna module of the above embodiments has uniform distribution in various measurements.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An electronic device, comprising:

a plurality of electronic elements; and an antenna module, comprising:

a grounding body covering the electronic elements so as to serve as a shielding casing of the electronic elements; and a radiating body, comprising a first sub-radiating body connected to the grounding body and a second sub-radiating body connected to the first sub-radiating body, the second sub-radiating body connected to the first sub-radiating body via an extension part extending from the second sub-radiating body in a direction opposite to the grounding body, wherein at least a radio frequency resonance is excited between the radiating body and the grounding body.

2. The electronic device according to claim 1, wherein the radiating body and the grounding body are integrally formed in one piece.

3. The electronic device according to claim 1, wherein the area of the grounding body is more than double of the area of the radiating body.

4. The electronic device according to claim 1, wherein the radiating body is protruded from a lateral side of the grounding body.

5. The electronic device according to claim 1, wherein the antenna module has a groove disposed between the radiating body and the grounding body.

6. An electronic device, comprising:

a plurality of electronic elements;

an antenna module, comprising:

a grounding body covering the electronic elements so as to serve as a shielding casing of the electronic elements; and a radiating body; wherein at least a radio frequency resonance is excited between the radiating body and the grounding body, and wherein the radiating body comprises:

a first sub-radiating body connected to the grounding body, wherein the first sub-radiating body has a first length; and a second sub-radiating body connected to the first sub-radiating body and disposed between the first sub-radiating body and the grounding body, wherein the second sub-radiating body has a second length smaller than the first length.

7. The electronic device according to claim 5, wherein the second sub-radiating body is further connected to the grounding body, and wherein the first sub-radiating body has a first length and the second sub-radiating body has a second length smaller than the first length.

8. An antenna module disposed in an electronic device, wherein the electronic device comprises a plurality of electronic elements and an antenna module comprising:

a grounding body covering the electronic elements for being a shielding casing of the electronic elements; and a radiating body, comprising a first sub-radiating body and a second sub-radiating body, wherein the first sub-radiating body is connected to the grounding body and the second sub-radiating body is connected to the first sub-radiating body, and a central line of a part of the first sub-radiating body and a central line of a part of the second sub-radiating body are disposed on the same horizontal axis, and wherein at least a radio frequency resonance is excited between the radiating body and the grounding body.

9. The antenna module according to claim 8, wherein the radiating body and the grounding body are integrally formed in one piece.

10. The antenna module according to claim 8, wherein the area of the grounding body is more than double of the area of the radiating body.

11. The antenna module according to claim 8, wherein the radiating body is protruded from a lateral side of the grounding body.

12. The antenna module according to claim 8, having a groove disposed between the radiating body and the grounding body.

13. The antenna module according to claim 12, wherein the second sub-radiating body is further connected to the grounding body, wherein the first sub-radiating body has a first length and the second sub-radiating body has a second length smaller than the first length.

14. An antenna module disposed in an electronic device, wherein the electronic device comprises a plurality of electronic elements and an antenna module comprising:

a grounding body covering the electronic elements so as to serve as a shielding casing of the electronic elements; and a radiating body, wherein at least a radio frequency resonance is excited between the radiating body and the grounding body, and wherein the radiating body comprises:

a first sub-radiating body connected to the grounding body, wherein the first sub-radiating body has a first length; and a second sub-radiating body connected to the first sub-radiating body and disposed between the first sub-radiating body and the grounding body, wherein the second sub-radiating body has a second length smaller than the first length.

* * * * *